United States Patent [19]

Jeanneret

[11] 4,154,289

[45] May 15, 1979

[54] GATING SYSTEM

[75] Inventor: Miguel Jeanneret, Woodville Park, Australia

[73] Assignee: Marie-Therese Simian, Woodville Park, Australia; a part interest

[21] Appl. No.: 674,155

[22] Filed: Apr. 6, 1976

[51] Int. Cl.[2] ..... B22C 9/08

[52] U.S. Cl. ..... 164/358; 164/134; 164/362; 164/399

[58] Field of Search ..... 164/358, 134, 399, 362, 164/363; 249/108

[56] References Cited

U.S. PATENT DOCUMENTS

| | | | |
|---|---|---|---|
| 481,295 | 8/1892 | BLack | 164/410 X |
| 974,218 | 11/1910 | Wells | 164/399 |
| 1,188,938 | 6/1916 | Horner | 164/358 |
| 2,835,007 | 5/1958 | Hoefer | 164/358 |
| 3,080,628 | 3/1963 | Sundin | 164/358 X |
| 3,433,293 | 3/1969 | Ponzar | 164/358 |
| 3,572,421 | 3/1971 | Mezey et al. | 249/108 X |
| 3,682,435 | 8/1972 | Lofberg et al. | 249/174 X |

FOREIGN PATENT DOCUMENTS

| | | | |
|---|---|---|---|
| 1280495 | 10/1968 | Fed. Rep. of Germany | 164/358 |
| 417403 | 1/1947 | Italy | 164/358 |
| 41053 | 3/1925 | Norway | 164/358 |

*Primary Examiner*—Robert Louis Spruill
*Assistant Examiner*—Gus T. Hampilos
*Attorney, Agent, or Firm*—Oblon, Fisher, Spivak, McClelland & Maier

[57] ABSTRACT

A gating system of general application for pouring foundry molds by gravity, based on a distinct prefabricated casting skin-strainer, located along and following the casting surface, structurally constructed and mold supported to withstand the impact of falling molten metal and the consequent metalistatic pressure, all while the cavity is filled through a skin-strainer aperture and with the skin-strainer retaining its original position and shape. The skin-strainer is able, when necessary, to allow the feeding of the casting once the mold is full and before it is solidified. Depending on the casting to be poured the system may include an overhead melt distributor, and techniques for mold casting cavity venting and sprue-feeder extraction.

23 Claims, 94 Drawing Figures

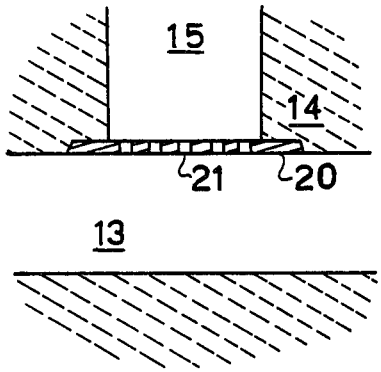
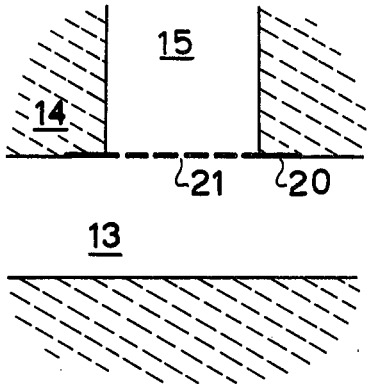
fig7b
fig 8
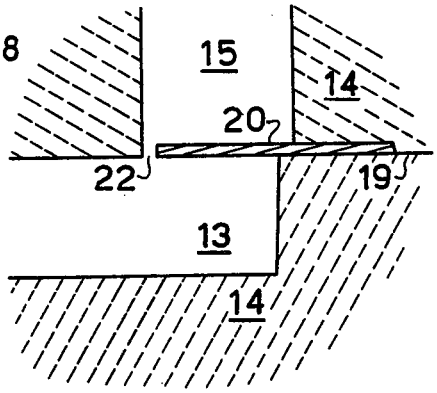
fig 9
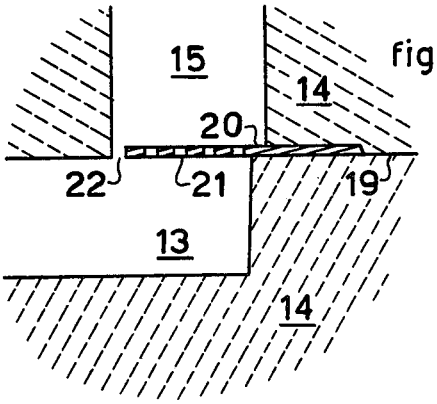
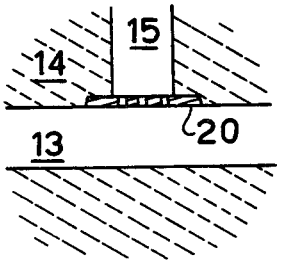
fig 10
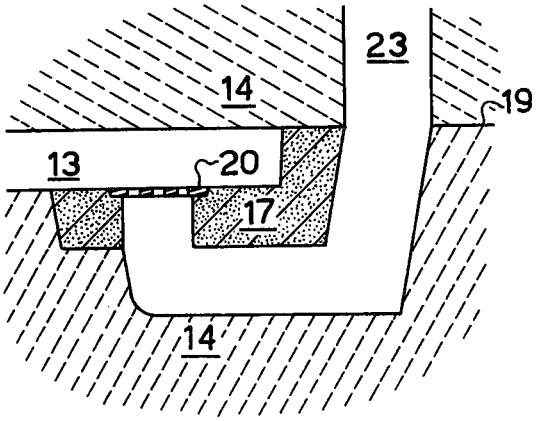
fig 12
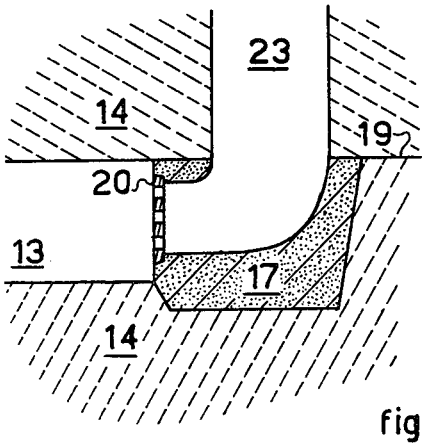
fig 11 fig 13
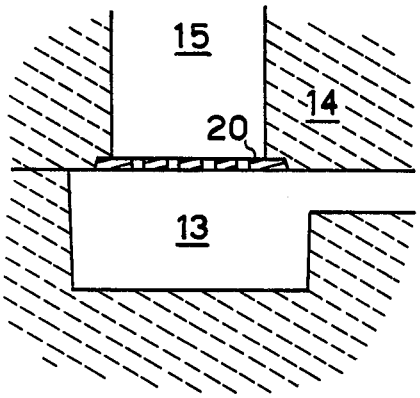
fig 14
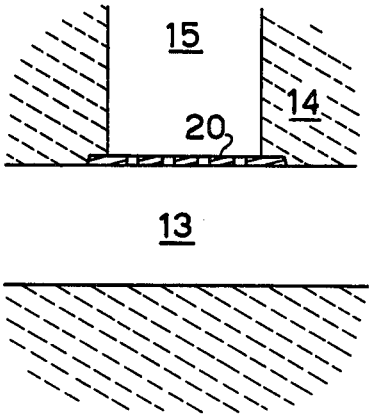
fig 15
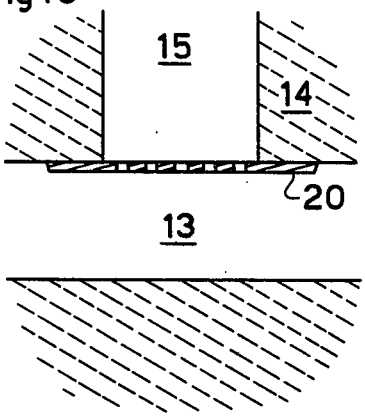
fig 16
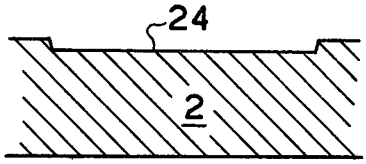
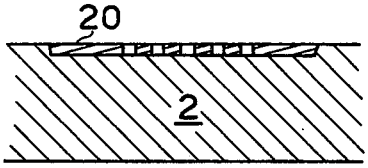
fig 17
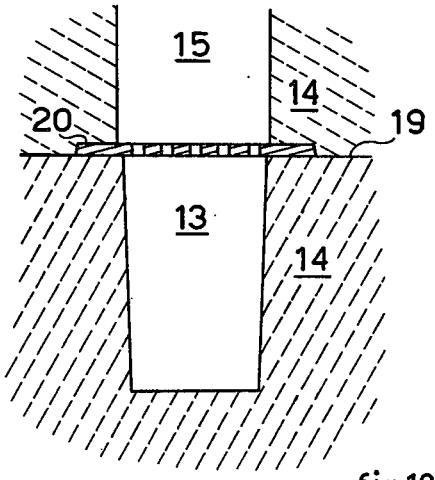
fig 18 fig 19
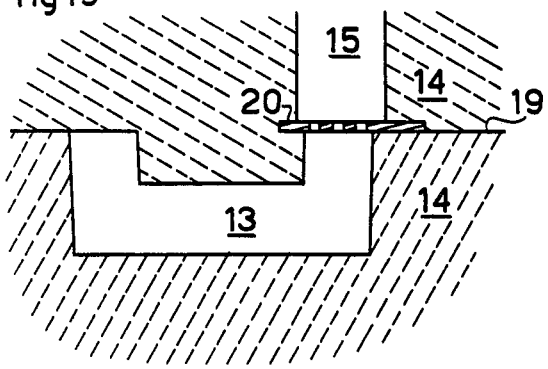
fig 20
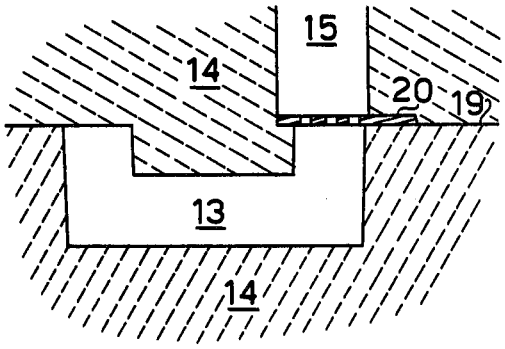
fig 21
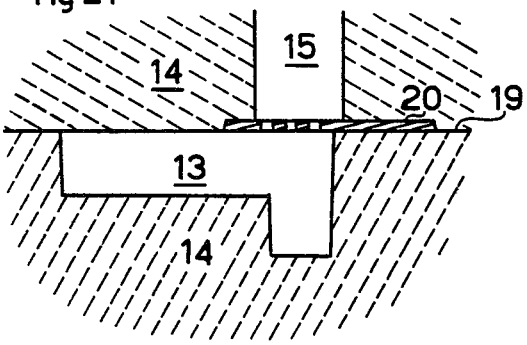
fig 22
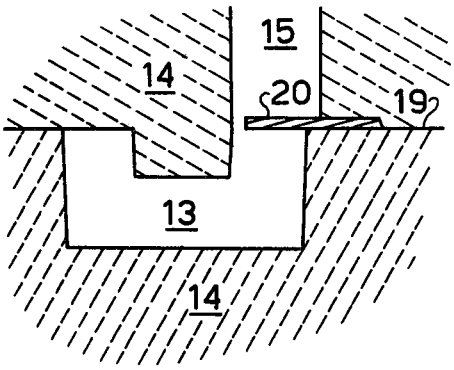
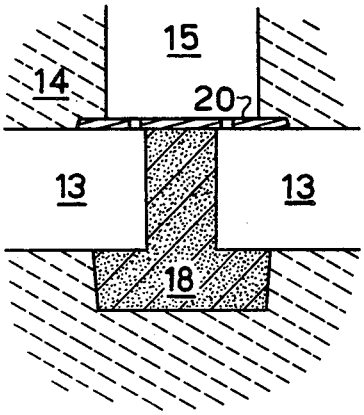
fig 23
fig 24
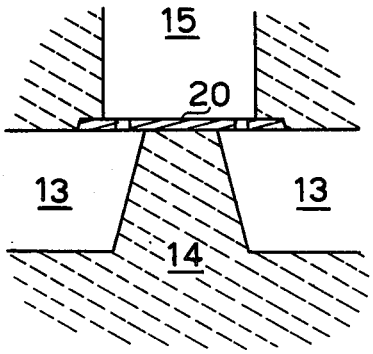

fig 27
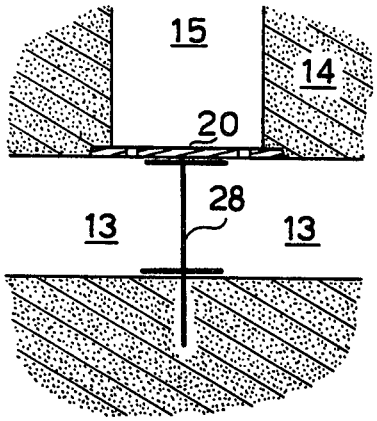
fig 28
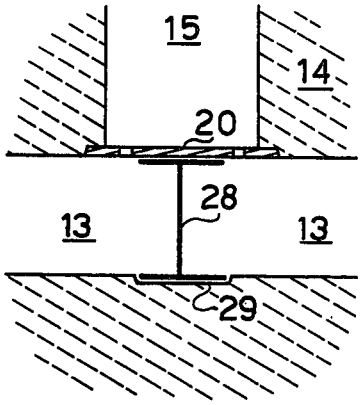
fig 29
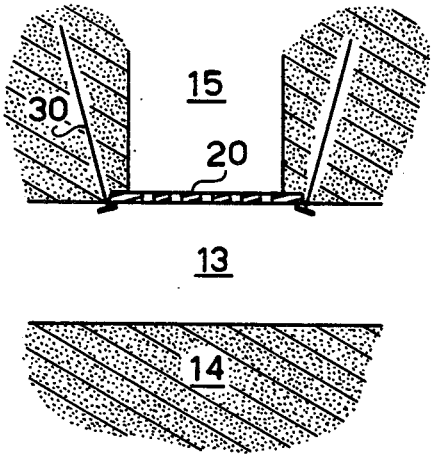
fig 30
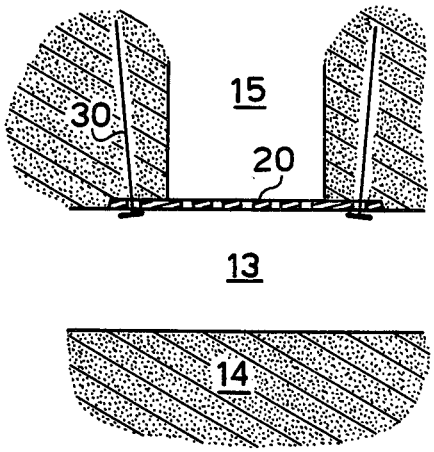
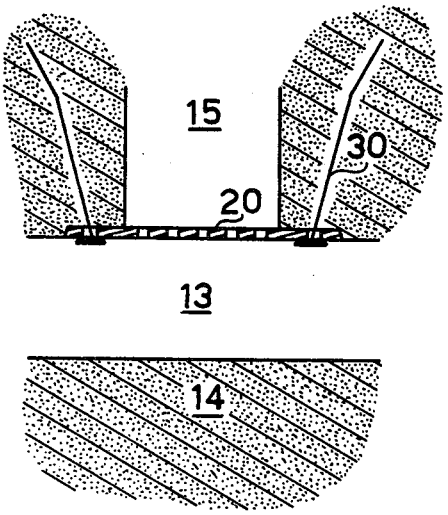
fig 31
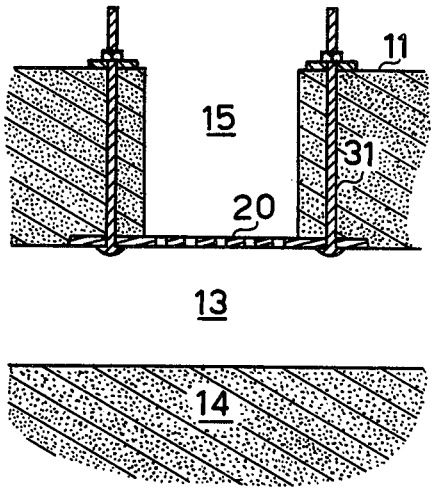
fig 32 fig 33
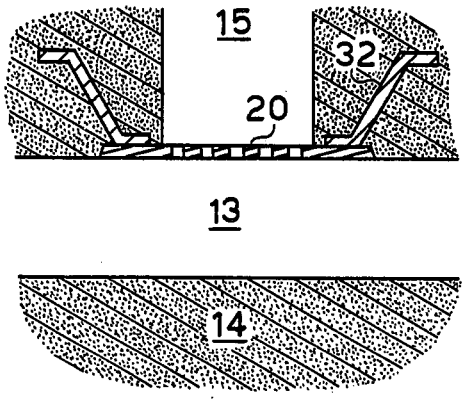
fig 34
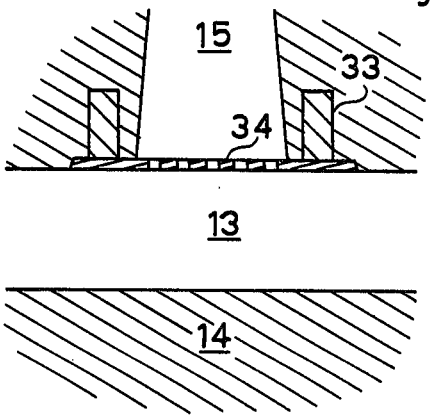
fig 35
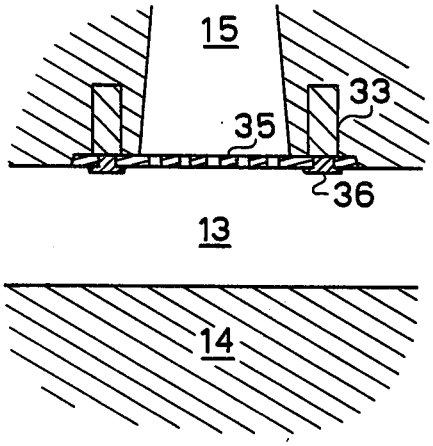
fig 36
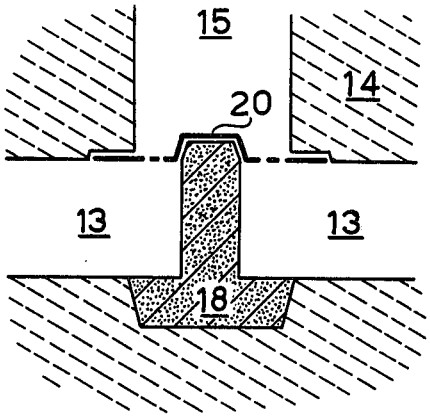
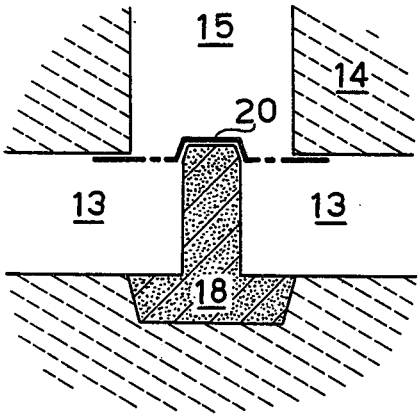
fig 37
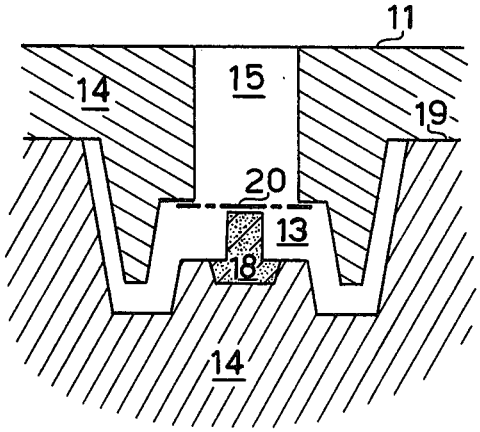
fig 38a fig 38 b
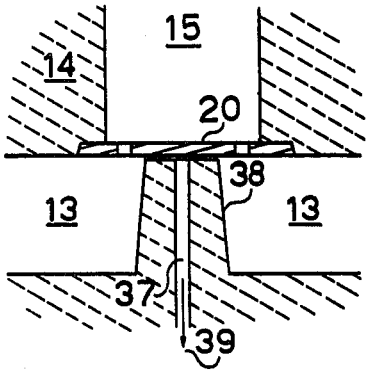
fig 39
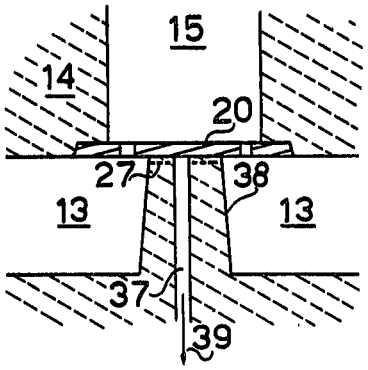
fig 40
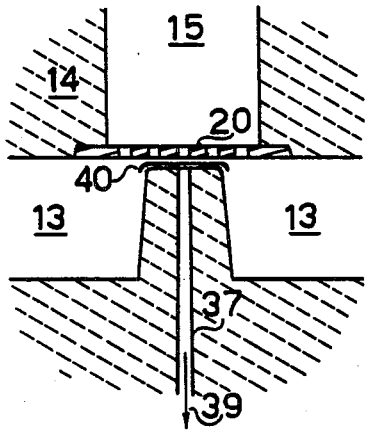
fig 41
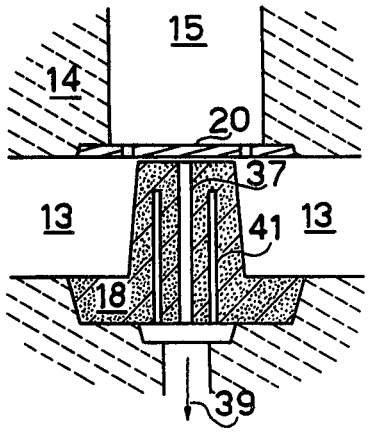
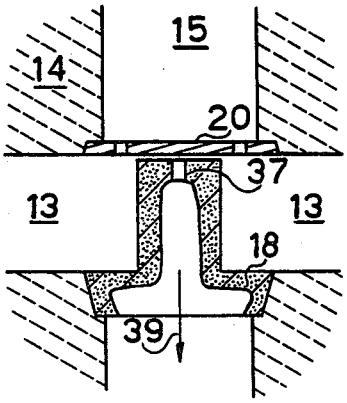
fig 42
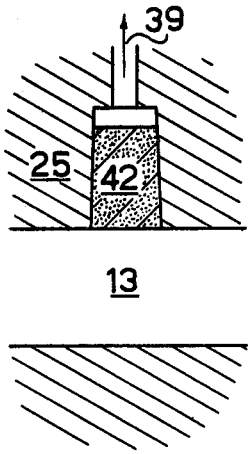
fig 43a
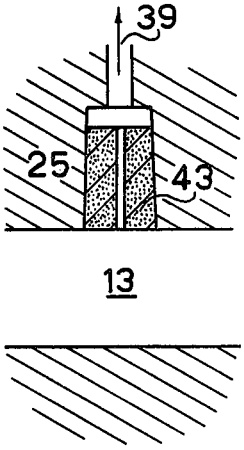
fig 43b fig 44
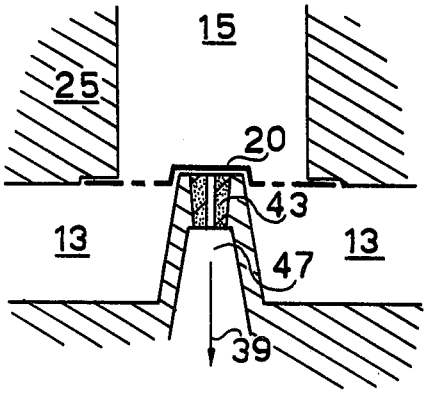
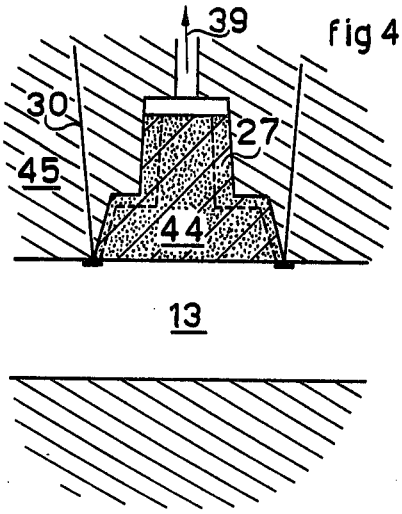
fig 45
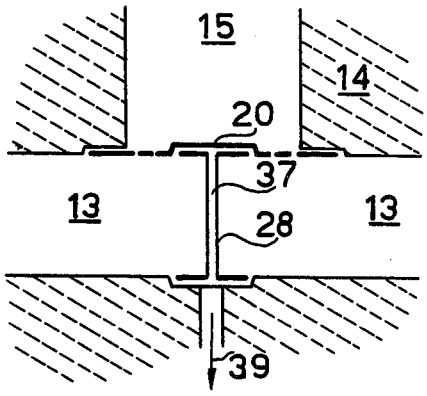
fig 46
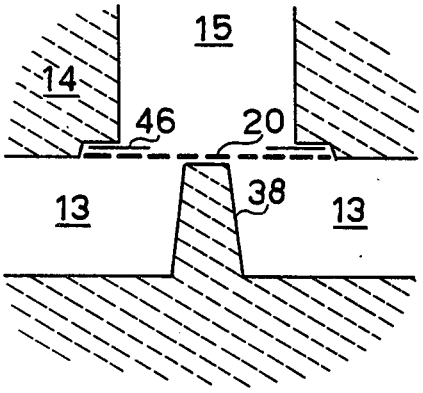
fig 47a
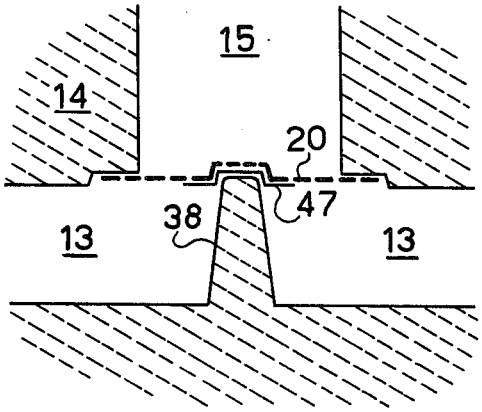
fig 47b fig 50
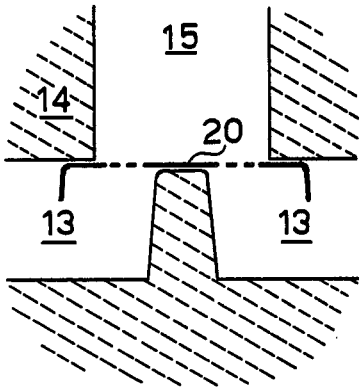
fig 51
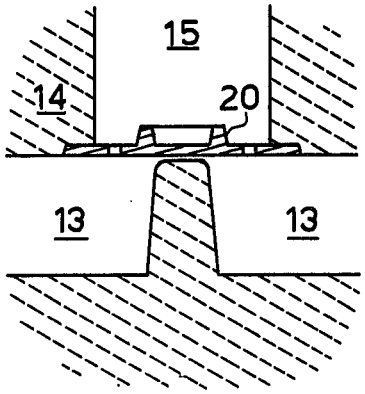
fig 52
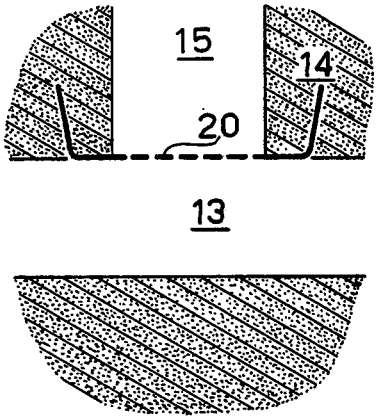
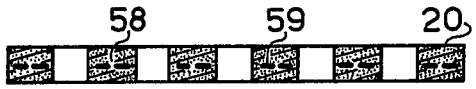
fig 53
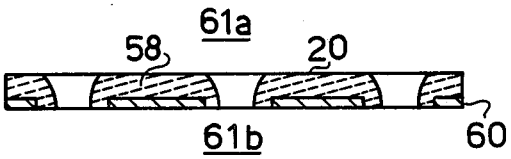
fig 54
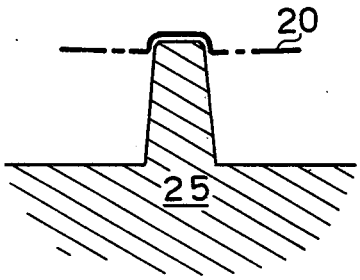
fig 55a
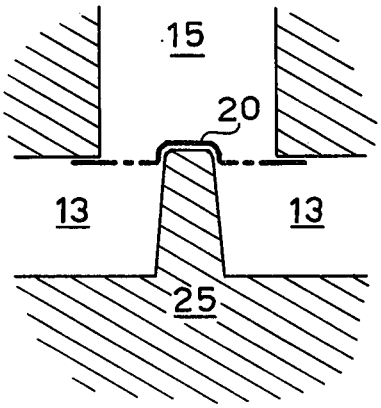
fig 55b

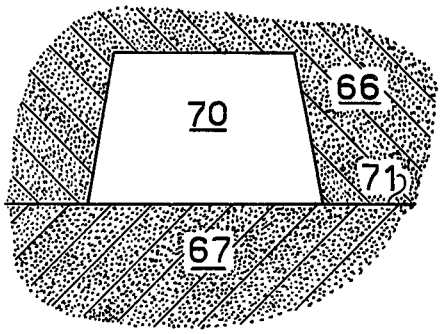
fig 61a
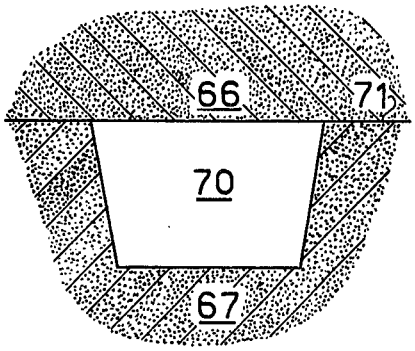
fig 61b
fig 61c
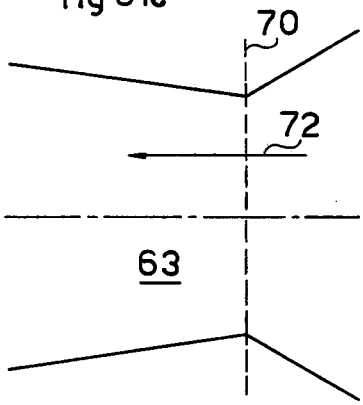
fig 62d
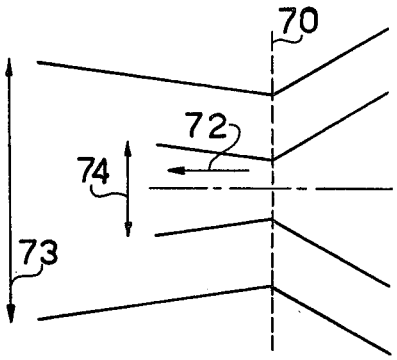
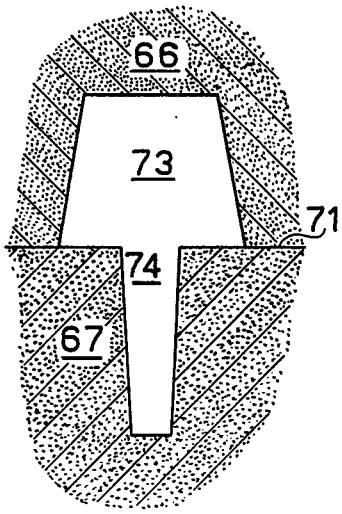
fig 62a
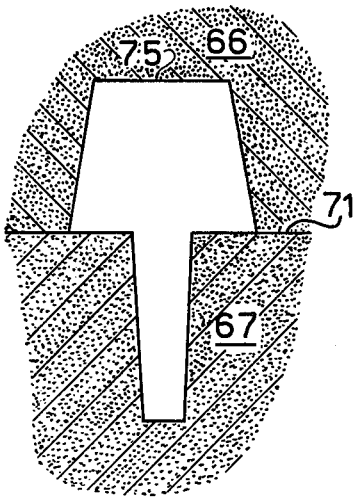
fig 62b
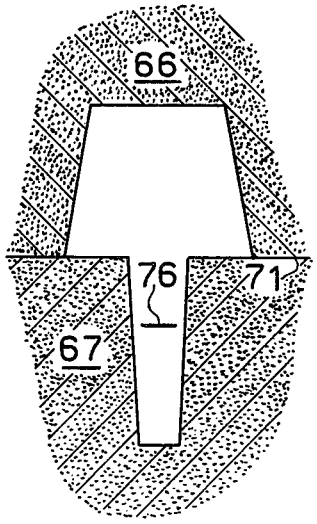
fig 62c fig 63a
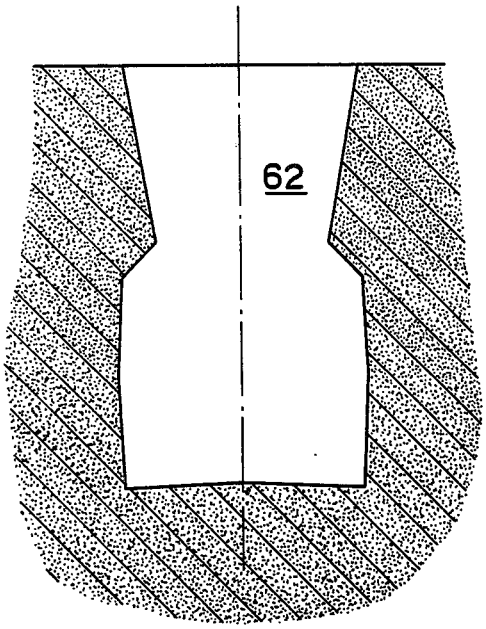
fig 63b
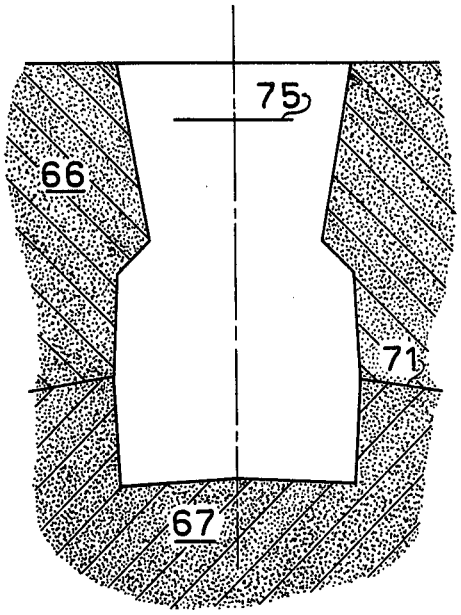
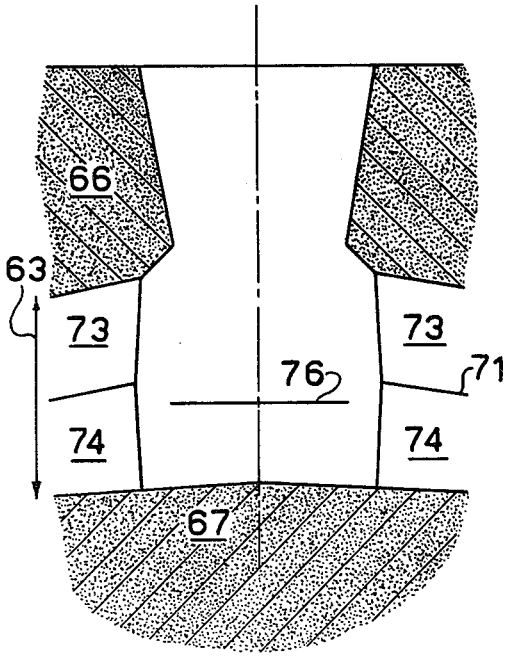
fig 63c
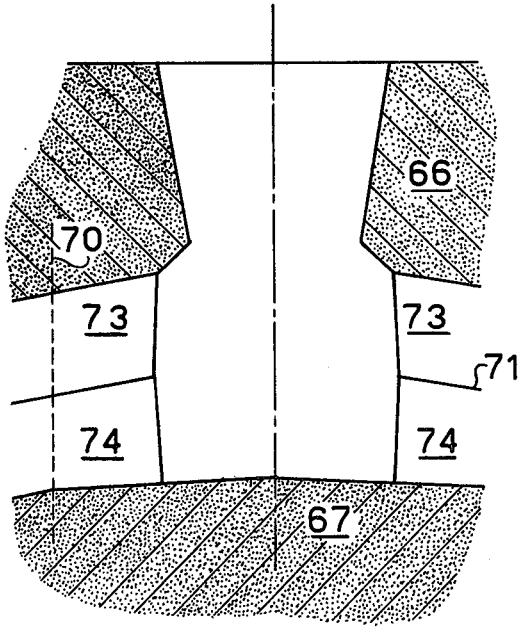
fig 63d

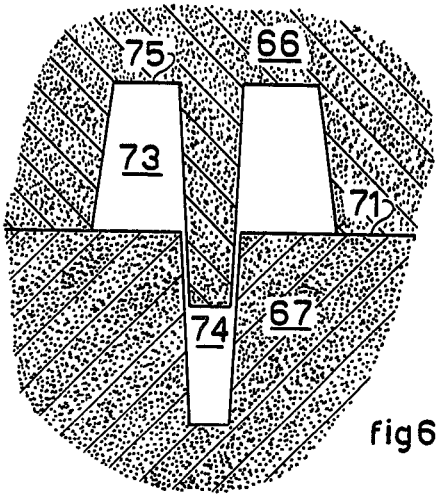
fig64a
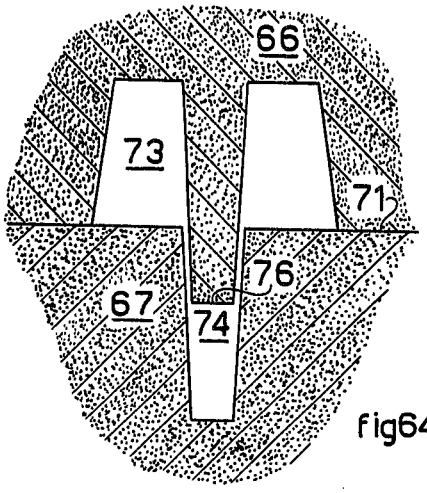
fig64b
fig65a
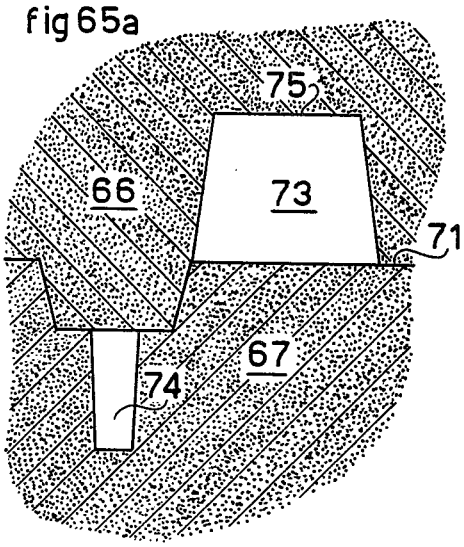
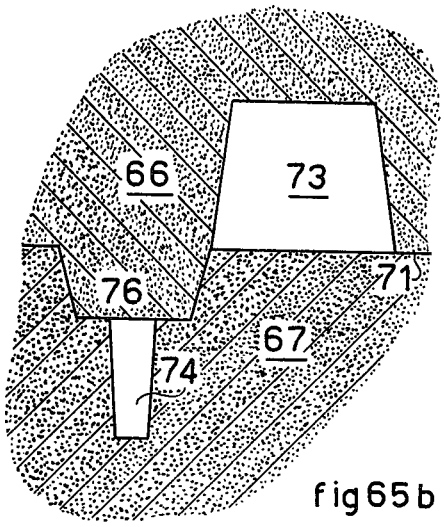
fig65b
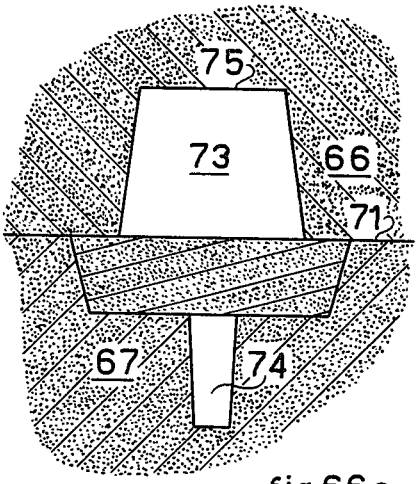
fig66a
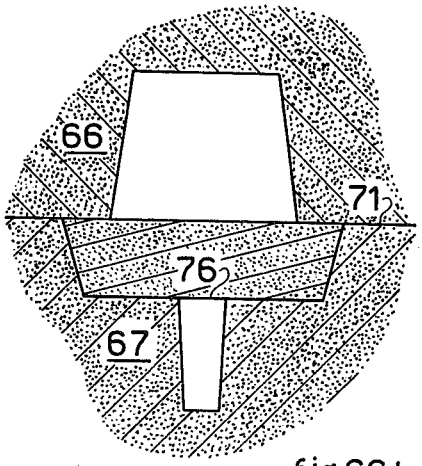
fig66b fig 67a
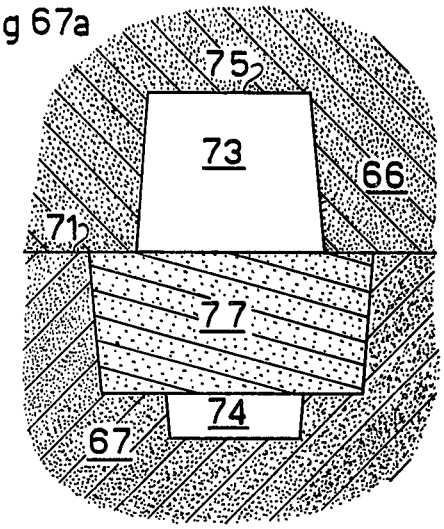
fig67b
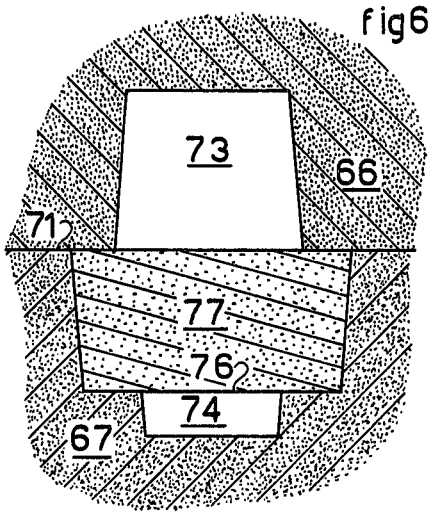
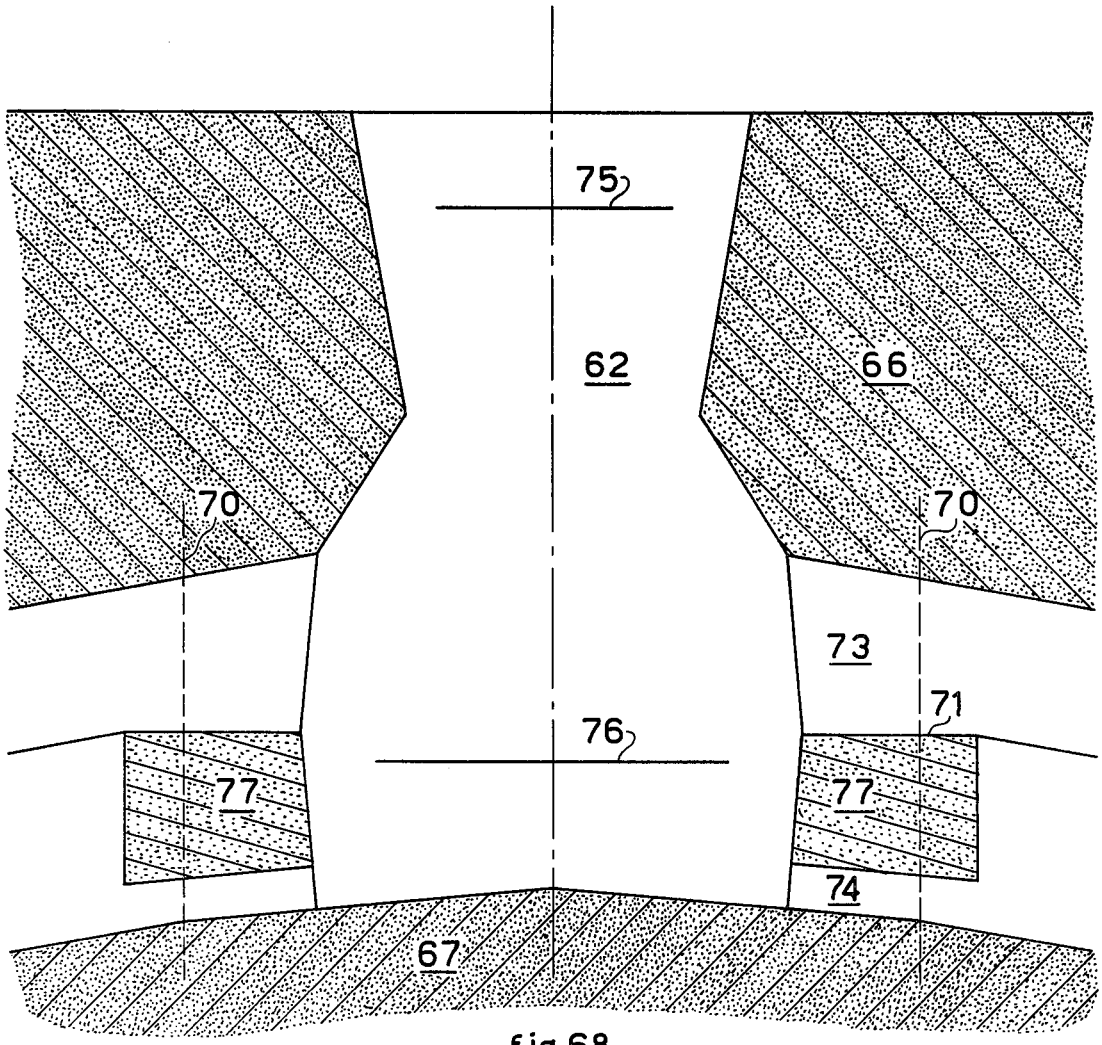
fig 68 fig 69a
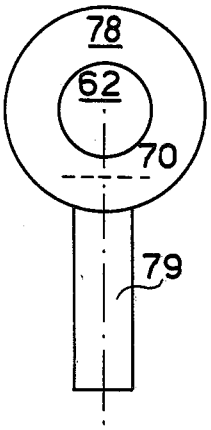
fig 69b
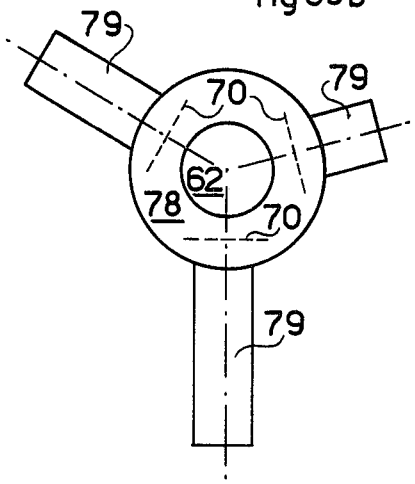
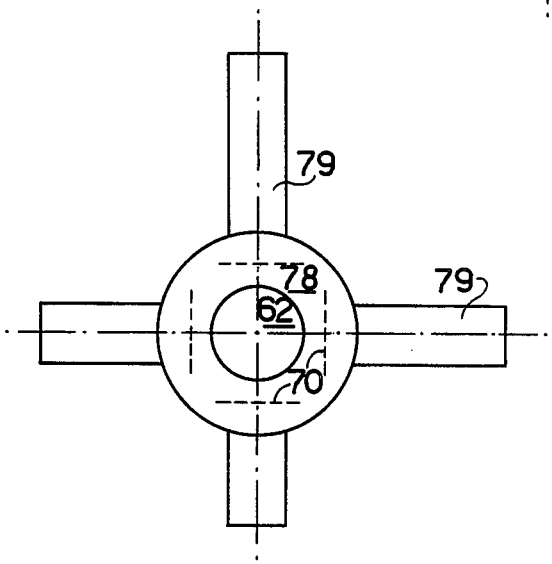
fig 69c
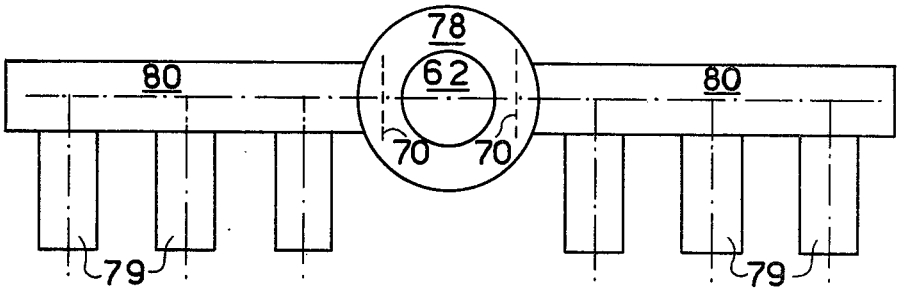
fig 69d

GATING SYSTEM

BACKGROUND OF THE INVENTION

1. Field of the Invention

This gating system is to be applied to any type of mold poured by gravity such as sand based, graphite based, metallic based, or a combination of different materials, etc., for pouring any metal compatible with the refractority and resistance of the materials available for making the skin-strainers, and for pouring castings with a wide range of size and shape.

2. Description of the Prior Art

When pouring a mold, through the gating system the flow of metal is controlled in order of avoiding turbulences and inclusions, and in order to properly fill the entire mold. After the mold filling is finished the gating system, if properly designed, promotes a good directional solidification through the casting.

Different types of gating systems are usually implemented. Examples of these are given in FIGS. 1 and 2 which figures have been established by the American Foundrymen's Society in order to illustrate the different parts of a gating system.

The gating systems presently in common use generally solve the problem of obtaining sound castings but at the same time very frequently present some adverse economical aspects which are:

1. Relatively high proportion of metal involved in the gating system.
2. Increased mold volume for accommodating the gating system.
3. Finishing operations for separating the gating system from the casting.
4. Creation of obstacles while the casting is cooling and contracting, which promotes deformations and internal stresses in the casting.

The aim of the present invention is to diminish the importance of these adverse aspects or even eliminate some of them but still keeping and even improving the conditions for producing a sound casting.

BRIEF DESCRIPTION OF THE INVENTION

This invention is based mainly on two accessories:

1. The skin-strainer which is always present.
2. The overhead melt distributor which use depends on the casting configuration.

The skin-strainer is located somewhere along the mold casting cavity surface but giving preference to those points requiring a traditional riser. The skin-strainer is related to the top mold surface through a conduit which we call a sprue-feeder. The sprue-feeder is connected with the mold casting cavity through the skin-strainer open area.

While different molding crafts can be used for locating a skin-strainer along the bottom or the side mold casting cavity surfaces, the most natural and advantageous location is the top mold casting cavity surface.

To fill the mold the melted metal is poured directly into the sprue-feeder at a rate, first sufficient to quickly fill a major proportion of the sprue-feeder thus choking it, and later at a lower rate sufficient to keep about constant the metal level in the sprue-feeder while the mold casting cavity is being filled through the skin-strainer.

To obtain a high quality casting, several feeding points may be necessary and as many skin-strainers and their corresponding sprue-feeders would be required.

In these instances, in order to avoid the necessity of having one pouring ladle per each sprue-feeder, an overhead melt distributor is provided on the top of the mold, this distributor permitting the pouring from one ladle into one distributor point from which the melt distributor simultaneously delivers the melt at the necessary rate required by each sprue-feeder and skin-strainer.

If the natural casting configuration does not provide for it, some venting procedures here described permit the venting of the area around the skin-strainer.

When the relatively weak connection achieved, through the skin-strainer, between the sprue-feeder and the casting cannot easily be knocked off, a sprue-feeder extractor provides for breaking this connection when the metal in the mold is already solid but still hot enough for it to be in a weaker condition.

While many foundry casting cases can be dealt with by only applying the gating system object of the present specifications, there will also be other cases where the present gating system will profitably be combined with the traditional established ways of gating a casting.

For example, in the present system there is basically one mold conduit connecting every skin-strainer to the top mold surface, but, in some cases it could be useful to join together somewhere inside the mold several of those conduits and connected to the mold top surface as only one conduit.

Another example would be the case of an overhead melt distributor designed for pouring simultaneously into several mold conduits not all of these conduits being related to a skin-strainer.

Quite often it will be possible to change the casting design without damaging its purpose but favouring the application of the present new system with its numerous advantages.

The main advantages of this gating system can be listed as follows:

1. To control, which means to restrict to any required degree the flow of metal or alloy being poured into a gravity foundry mold.
2. To limit sharply or even avoid melt turbulences inside the mold casting cavity, which turbulences most generally are casting defect generators. The effect of this gating system on the metal flow is similar to the one produced by the filter used at the kitchen sink to avoid splashings.
3. To limit sharply or even avoid the entry of any detrimental melt inclusions into the inside of the mold casting cavity.
4. To allow when necessary an adequate venting of the mold casting cavity around the ingate which venting often is difficult to achieve, mainly for metallic molds.
5. To assure the desired directional solidification of the casting and its gating system.
6. To provide the gating system with a minimum volume thus allowing the pouring of more molds per melt batch.
7. To minimize or even eliminate the fettling operations originated by the gating system.
8. To reduce the molding cost by using a more compact gating system which requires smaller molding boxes and allows more molds in the same molding area.
9. To reduce the internal stresses and deformations associated with the casting solidification and cooling, by minimizing the connections between the casting and its gating system.

Summing up the previous points it can be said that practicing this gating system it is possible to obtain a clear increase of the castings soundness,
dropping of the % of rejects
decrease of the castings cost.

BRIEF DESCRIPTION OF THE DRAWINGS

In order to more fully describe the invention reference will now be made to the drawings in which:

FIGS. 1 to 6 illustrate the definitions of some foundry technical expressions.

FIGS. 7 to 9 illustrate the skin-strainer open area.

FIGS. 10 to 12 show a skin-strainer positioned at the top, the side and the bottom mold casting cavity surface.

FIGS. 13 to 17 illustrate the embodiment of the skin-strainer in the mold or in the mold casting cavity.

FIGS. 18 to 26 show examples of self supported skin-strainers.

FIGS. 27 to 35 show examples of supported skin-strainers.

FIGS. 36 and 37 shows examples of skin-strainer locations.

FIG. 38*a* shows an example of where the mold venting is not naturally provided by the casting configuration.

FIGS. 38*b* and 39 to 42 and 44 and 46 illustrate the venting of the mold casting cavity through a central support supporting a skin-strainer.

FIGS. 43 and 44 illustrate the venting by using a venting pellet.

FIG. 45 illustrates the venting by using a venting core.

FIG. 46 shows the venting of the mold casting cavity through a special chaplet.

FIGS. 47*a* and *b* show the use of an annular cover or of a central cover for adjusting the skin-strainer open area.

FIGS. 51 to 52 show reinforcements of the skin-strainer shape.

FIGS. 53 and 54 show a cross-section of two material skin-strainers.

FIGS. 55*a* and *b* illustrate the use of a predeformed skin-strainer located over a central support.

FIGS. 61, 62 and 64 to 67 show critical cross-sections of distributor channels.

FIGS. 63 and 68 show cross-sections of distributor sprues.

FIG. 69 illustrates the distributors centres and auxiliary channel extensions to be used with big molds.

DETAILED DESCRIPTION OF THE INVENTION

In order to more clearly understand the invention various definitions will now be given so that the clear meaning and scope of the invention can be determined. The word metal is used to mean a pure metal or an alloy. A melt is a batch of melted metal. A gravity mold is any foundry mold filled with melted metal under the effect of gravity.

Figure 1:
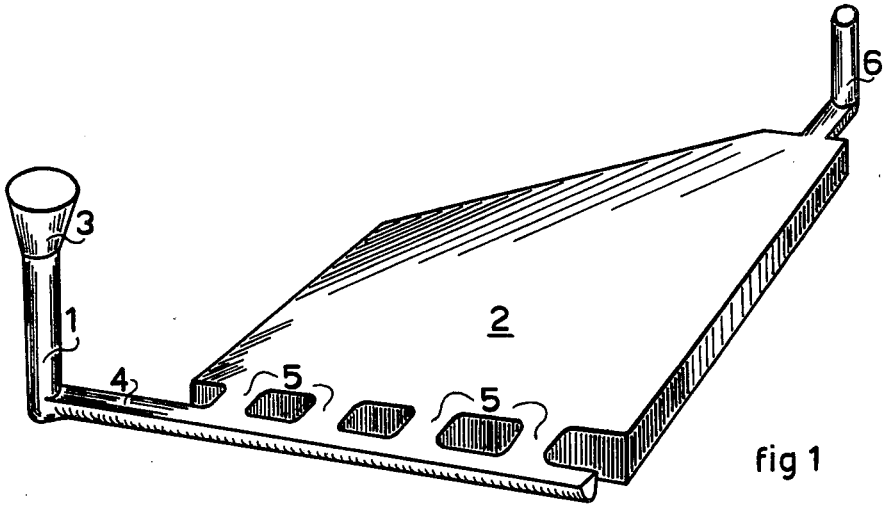
FIGS. 1 and 2 show conventional casting techniques as illustrated by the American Foundrymen's Society.
Figure 2:
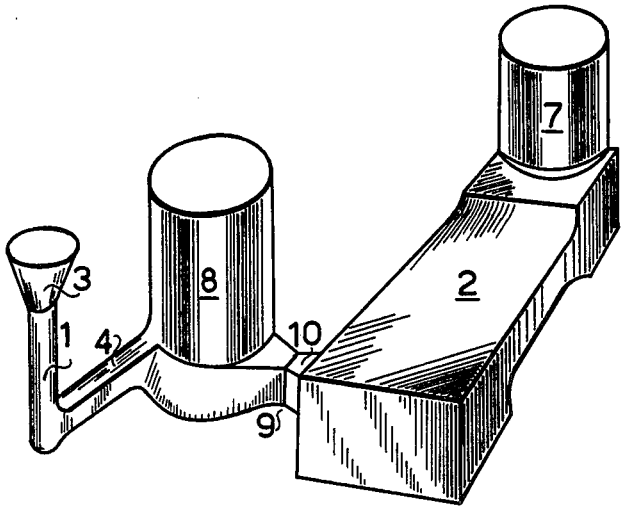
Figure 3:
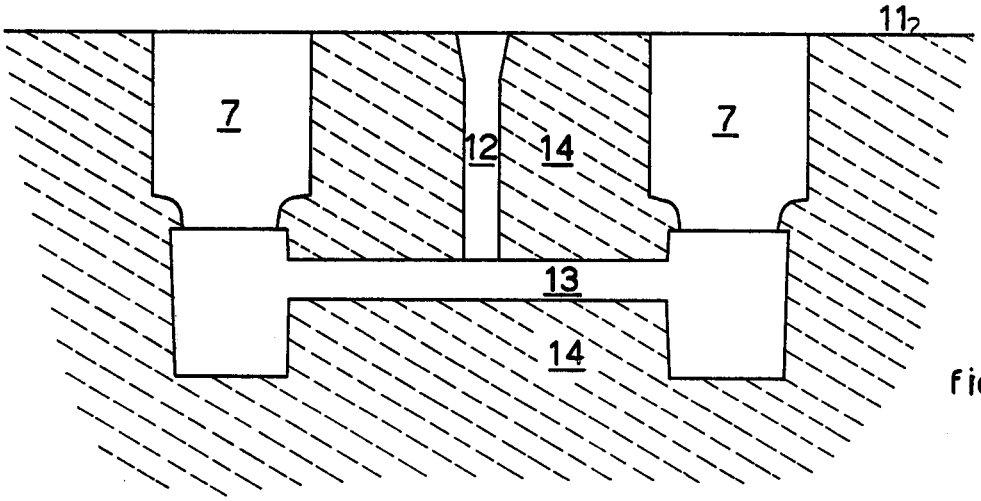
Figure 4:
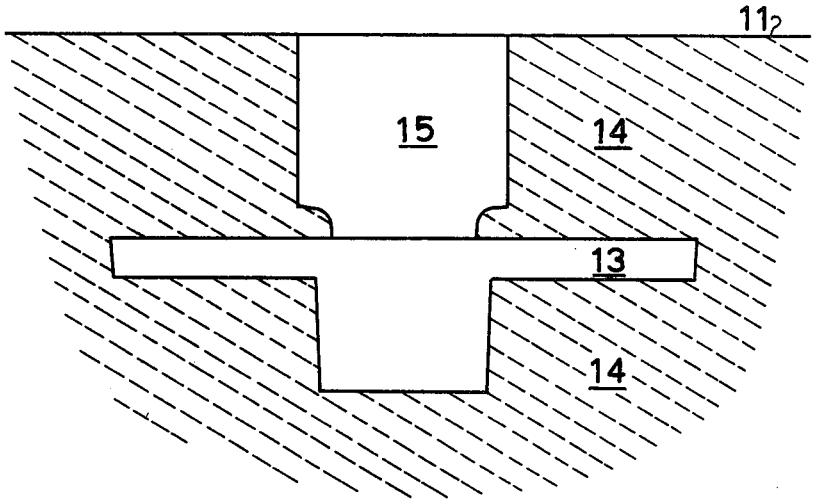

A sprue 1 is as shown in FIG. 1 the first conduit, usually vertical through which the metal enters the mold (also called downsprue) where the casting 2 is being produced. The pouring cup 3 is the generally flared top part of the sprue. A runner 4 is the second conduit usually horizontal through which the metal flows toward or is distributed around the mold casting cavity. An ingate 5 is the third conduit through which the metal leaves the runner to enter either the mold casting cavity or the riser adjacent to the cavity as shown in FIG. 2. A flow off 6 is a large vent usually located at the higher level of the mold casting cavity. A riser or feeder is a reservoir connected to the casting so as to provide liquid metal to the casting during solidification to offset the shrinkage which takes place when the casting solidifies. A riser can be a top riser 7 or a side riser 8 being connected to the casting through a riser neck 9 and a riser pad 10. A riser usually finishes at the top mold level 11 (FIG. 3).

A direct sprue 12 is a conduit fulfilling simultaneously the object of a sprue, a runner and an ingate. It is usually unsuitable for producing a good quality casting, but can be made suitable in many cases by using a skin-strainer as defined in the present specification.

The mold casting cavity 13 is the part of the mold 14 which correspond to the casting to be produced as defined per sample or per casting drawing. The mold casting cavity surface is the internal mold surface which correspond to the external casting surface of the casting to be produced with the mold.

A sprue-feeder 15 is a conduit fulfilling simultaneously the object of a sprue, a runner, an ingate and of a feeder. This is also most generally unsuitable for producing a good quality casting but also may be made suitable in many instances by using a skin-strainer and this with multiple advantages in the quality and economic point of views. When the sprue-feeder is located over the mold casting cavity it is a direct sprue-feeder 15 or otherwise it is a lateral sprue-feeder.

The gating system is the complete assembly of sprues, runners, ingates, vents, flow-offs, feeders necessary to pour and produce a good casting. Directional solidification is the solidification of the melted metal in a mold casting cavity so that feeding metal is always available for that portion just solidifying. Feeding is the effect produced by a feeder.

Figure 5:
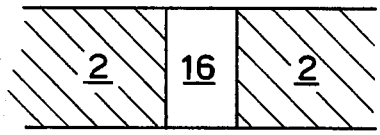
Figure 6:
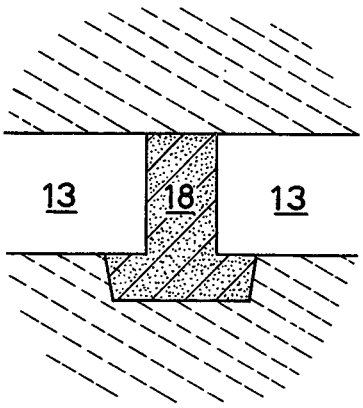

A through hole 16 FIG. 5 is a hole communicating one side of a casting thickness to the other side. A core 17 FIGS. 11 and 12 is a separate part inserted in a mold to shape the interior or that part of a casting which cannot be shaped by the pattern, or at least which is more easily obtained with such separate part. A through hole core 18 FIG. 6 is a core producing in a finished casting a through hole. A parting surface 19 FIGS. 11 and 12 is the mold surface which is common to at least two different mold parts and which starts at the mold casting cavity surface and finishes at the outside mold surface. A chaplet is a metallic support or spacer used in molds to maintain cores, or in general parts of the mold which are not self supporting in their proper positions during the casting process. A gagger is a metal piece of an irregular shape usually an L or Z shape, used to establish a stronger connection between different parts of a sand mold.

Fettling also called foundry finishing operations or just finishing is the process of removing, after the mold is poured and shaked out, the complete gating system and flashes from the casting and carrying out any necessary operations to produce the casting dimensioned and shaped in accordance with the casting drawing or sample.

The open area of a strainer is the sum of all the small individual areas through which the metal can flow. The critical cross-section of a metal conduit is the section whose shape and area set the rate of metal passing through the conduit. A mold vent is a small conduit passing from the mold casting cavity surface to allow the air and other possible gases escape as the metal fills the mold. Flow-off is a large vent, usually located at the high points of the mold casting cavity. Venting is the effect produced by vents and flow-offs, also promoted through feeders, through mold parting surface, through mold and core permeability.

Turning now to the skin-strainer itself, the skin-strainer is a form of barrage placed along the mold casting cavity surface where the sprue-feeder or the like reaches this surface. As shown in FIG. 7*a* a skin-strainer 20 with holes 21 therein is situated at the entrance of the sprue feeder 15 into the mold casting cavity 13, FIG. 7*a* showing the skin-strainer of substantial construction whereas FIG. 7*b* shows the strainer of a thinner construction. The holes required may be as many as necessary and of a spacing to produce the required open area through the skin-strainer.

As shown in FIG. 8 the skin-strainer may be spaced from an edge of the sprue-feeder 15 to form a gap 22 which constitutes its open area.

FIG. 9 shows the combination of FIG. 8 with the features of FIG. 7*a* to show a skin-strainer with holes and also the utilization of a gap 22.

The skin-strainer will generally but not necessarily be located at the top of the mold casting cavity surface FIG. 10. But by using a lateral sprue-feeder 23 it can also be located at the side of that surface as shown in FIG. 11 or at its bottom as shown in FIG. 12. These positions will be chosen with a view to shortening to a minimum the distance between the ladle and the mold casting cavity, also with the view of bringing the metal to the central parts of the cavity, instead of its edges as usual, for maximising the feeding action.

The skin-strainers can be used in any form of gravity mold either being sand based, graphite based, metallic based or the like, and it also can be a gravity mold combining the use of different materials as for example a metallic mold with bonded sand cores. Also the skin-strainers can be used for pouring any type of metal compatible with the refractority and resistance of the materials available to make the strainers.

The skin-strainer can be made of any suitable material and can be the flexible or rigid. Flexible skin-strainers can be formed from a plane metal sheet with holes punches therein, a perforated metal sheet, expanded metal sheet, metallic mesh or the like while rigid strainers can be formed of ceramic materials, bonded sand core, metal or the like.

The term "flexible" means that the material allows the possibility of deformations in the skin-strainer manufacturing process or when it is located in the mold, while the term "rigid" means that the corresponding material must not be deformed either because it is breakable or because it is too strong.

Whatever the material used and whatever its thickness, the strength of the skin-strainer at the metal pouring temperature must be compatible with its size, shape and support and with the required strength necessary to withstand the impact and pressure which takes place when the mold is being poured.

It will be realised that the skin-strainer must generally be clean and must be kept in this condition. It can be protected, but the protective material used must not be damaging to the quality of the metal to be poured.

The filtering capacity of the skin-strainer can be increased by pressing between the strainer and its mold seat one or several layers of a material having finer holes, like fine sheets of perforated or expanded metal, metallic mesh, fibre glass fabrics or the like.

The refractority of a skin-strainer can be increased by protecting it with some material more refractory than itself, as for example by embedding a steel skin-strainer in a bonded sand core material.

It is important to note that the impact and pressure applied on a skin-strainer only last for a short period of time, that is the pouring time, which is usually only a matter of seconds. It does not matter if the skin-strainer reaches a collapsing temperature when the mold has been already filled, as long as the skin-strainer remains, with its original shape and position and as a distinct material to ensure the ease of separation of the sprue-feeder therefrom.

Thus in one example a skin-strainer can be made from a perforated steel tin plate of only ten thousandths of an inch thick, which is able to withstand the pouring from a height of 15 inches of an aluminium alloy at 800° C. for more than 20 seconds over a four inch span, being the strainer open area only 10% of the sprue-feeder cross-section and formed by 1/16th " holes, without having the strainer collapsing to any extent. This happens, in spite of the fact that steels generally loose the very high proportion of their strength when heated over 500° C.

In order to decide which skin-strainer material would be satisfactory for a particular application tests may be carried out. Through these tests it is possible to quickly elucidate the right type of material, the right shape, thickness, holes, supporting method for the skin-strainer and obtain a good mold filling, a good filtering effect, an easy separation of the sprue-feeder from the casting.

For these tests a simple casting is designed as being representative of the largest actual casting thickness and of the casting area to be fed. This casting will be filled and fed through a sprue-feeder whose dimensions will be choosen applying the traditional risering technique. At the bottom of this sprue-feeder and along the casting surface the skin-strainer to be tried will be lcoated as it would be on the actual casting to be produced. The mold made for that simplified test casting will have at its lower level a tape hole in order to have the opportunity if desired of pouring through the skin-strainer the same amount of metal which is required for the actual casting. While pouring the testing mold its tape hole is closed at the due time to obtain the mold filled with the remaining metal.

The skin-strainer 20 will preferably be positioned at that point requiring late feeding after the mold has been filled, a point which usually would need to have a conventional feeder as shown in FIG. 13.

The skin-strainer is made coincident with the casting surface. Preferably as shown in FIG. 13 and 14 the skin-strainer thickness is embedded in the mold volume but may also be embedded into the mold casting cavity as shown in FIG. 15 if it is considered that the skin-strainer would not damage the casting in any way or cause any inconvenience by leaving a depression 24 on the casting surface as shown in FIG. 16 or by staying in the casting as shown in FIG. 17.

The skin-strainer must be supported in position and the skin-strainer must withstand its own weight plus the impact and pressure developed during the pouring operation and for convenience the skin-strainers could be classified into two groups of support, these being firstly the self supported skin-strainers as shown in FIGS. 18 to 26 and secondly the skin-strainers requiring special support in FIGS. 27 to 37 as shown.

As shown in FIGS. 18 to 20 the skin-strainer is in a self supporting bridge position while in FIGS. 21 and 22 the skin-strainer is in a self supporting corbel position.

Figure 25A:
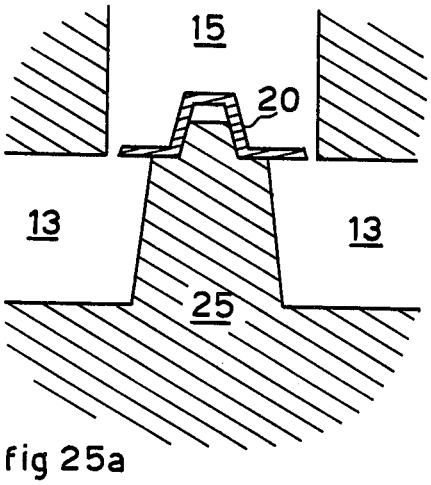
Figure 25B:
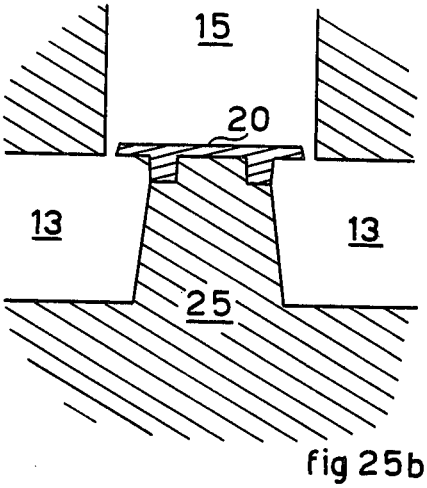

In FIGS. 23 to 25 the skin-strainer is in a self supporting over through hole position. In FIG. 23 the through hole is formed by a through hole core while in FIG. 24 it is formed by a simple extension of the mold 14. In FIGS. 25 *a* and *b* the through hole is formed by an extension of a metallic mold 25. In the cases shown in FIGS. 23 and 24 the skin-strainer is just standing on the through hole support. In the cases shown in FIGS. 25 *a* and *b* the metallic through hole support must be able to withstand a moment because the skin-strainer gap extends all around the skin-strainer. This moment appears mainly at the beginning of the pouring operation and while the prefilling of the sprue-feeder 15 is taking place.

Figure 26A:
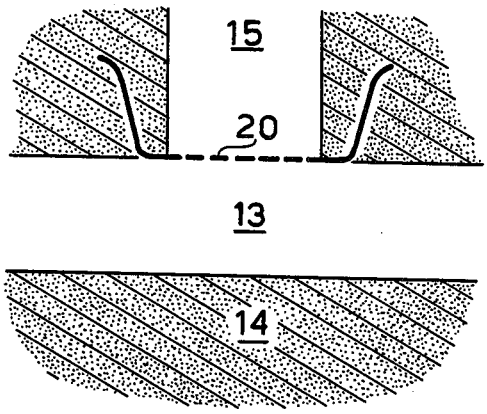
Figure 26B:
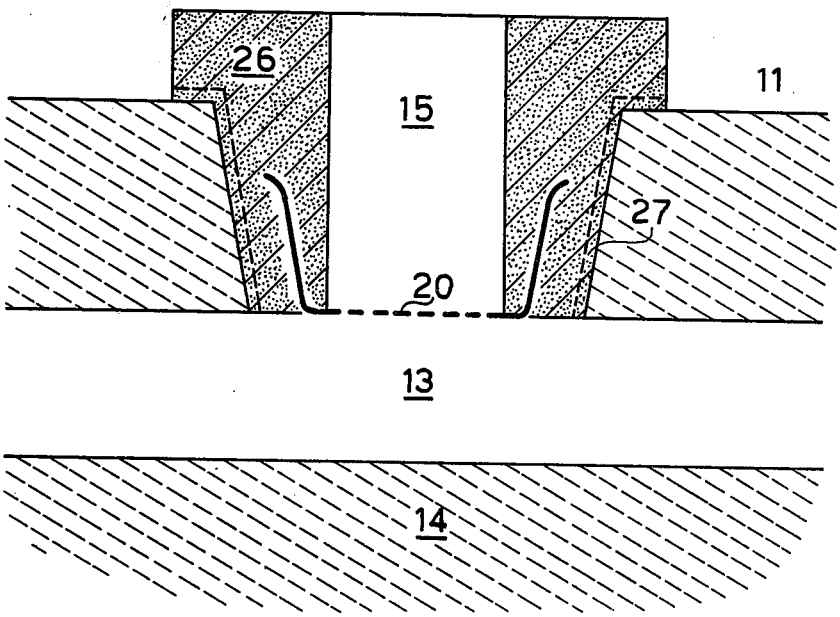

As shown in FIGS. 26 *a* and *b* the skin-strainer 20 is metallic and given a cup shape in order to embed the side of the cup in molding bonded sand while the mold is being formed. In FIG. 26 *a* the skin-strainer is just embedded in the top part of the mold. In FIG. 26*b* the skin-strainer is embedded in a separately formed bonded sand core called a skin-strainer holder core 26 which can be used in a sand mold or in a permanent mold, and which at the same time can have mold casting cavity venting grooves 27.

In FIGS. 27 and 28 the skin-strainer 20 is supported by a chaplet 28 inserted in the mold casting cavity 13. FIG. 27 shows one type of chaplet while FIG. 28 shows a depression in the bottom part of the mold for more accurately locating the chaplet.

FIGS. 29 and 31 show the supporting of the skin-strainer within a sand mold by using foundry nails 30 just at the contour of the skin-strainer or by having some special holes in the skin-strainer for passing the nails through or still having the nails suitably bent as shown in FIG. 31 to form a more suitable anchorage for the strainer.

FIGS. 32 and 33 show other ways of supporting the skin-strainer within a sand mold. In FIG. 32 it is by using bolts 31 and in FIG. 33 it is by using gaggers 32 welded to a metallic skin-strainer. In the case as shown in FIG. 32 the skin-strainer will be placed in the mold after the mold is formed and using the holes left to pass the bolt through, while in the case as shown in FIG. 33 the skin-strainer will be placed when the mold is being formed. (The same happens in FIG. 31).

FIGS. 34 and 35 show two other cases of supporting the skin-strainer in a metallic mold by using permanent magnets 33 inserted in the mold, the skin-strainer being iron based 34 in the case of FIG. 34 and nonmagnetic 35 in the case of FIG. 35 but supported by using steel rivets 36.

The skin-strainer should be easily located in its correct position and depending on the casting particularities the positioning can be achieved by having a mold depression corresponding to the skin-strainer thickness and contour. In this case the skin-strainer would be embedded in the mold. Alternatively using the mold casting cavity surface as a reference the skin-strainer can be embedded in the mold casting cavity. In a further alternative where there is a central part of the skin-strainer having a shape matching with its central mold support, as shown in FIGS. 36 and 37, the skin strainer is in this case embedded either in the mold as in FIG. 36 or in the mold casting cavity as shown in FIG. 37.

In order to obtain a quiet flowing of the metal into the mold without any turbulence through the skin-strainer and into the mold casting cavity it is essential to adequately vent this cavity to avoid any internal gas or air pressure occuring in the mold, particularly around the skin-strainer area.

Traditional foundry venting procedures for sand and metallic molds may be used, but the position for venting can often be coincident with the selected place of locating the skin-strainer and this could create problems, particularly for metallic molds as shown in FIG. 38*a*.

Thus to overcome these problems the venting can either be by firstly a venting tube, secondly venting through a central support, thirdly the use of a venting pellet or fourthly the use of a venting core.

Considering first the use of a venting tube, in this method a tube is comprised of a material which is refractory at the melt temperature and which does not modify the melt in any detrimental way. In this respect it is only necessary for the tube to have a refractory life of just a little longer than the pouring time for once the mold is full it does not matter if the poured metal melts and enters the tube for at this stage the venting has already been completed and even if the tube does not collapse the metal will enter the tube in any case.

The venting tube will extend from just underneath the skin-strainer through the skin-strainer itself and up to a level higher than the mold top. A relatively small tube will generally produce in most cases the right degree of venting and a special hole should be formed in the skin-strainer for passing the tube through.

The tube may be pulled out soon after the mold casting cavity is full and before solidification of the metal takes place. If desired the tube can be left in the sprue-feeder if this does not impede the reuse of the sprue-feeder as the metal to be remelted, or the sprue-feeder can even be left as unrecoverable material if the whole economy of the process is still favourable.

If the tube can be removed from the sprue-feeder before the metal solidifies, then one tube can often be reused for several pourings.

In the second alternative as shown in FIG. 38*b* the venting can take place through a mold casting cavity vent 37 passing through a skin-strainer central support 38, which vent is connected to atmosphere 39, with the skin-strainer being located over and in contact with this central support 38 which could be a through hole core, a mold extension, a chaplet or the like.

The venting passage 37 extends from the top of the central support 38 through the support and is communicated at its other end to atmosphere so that the communication with the mold casting cavity 13 is established through the skin-strainer 20 and support 38 interface.

If desired additional small venting grooves 27 as shown in FIG. 39 may be provided across the top of the central support, these grooves being small enough to allow the air and other gases to pass therethrough but restricting the passage of the metal towards the central support passage 37 before solidification.

If the mold is metallic and the support is also metallic the venting grooves should preferably be tapered so that even if some metal does pass therethrough the corresponding small flashes will be released with the casting at the ejection time.

If the raw material used for manufacturing the skin-strainer is an open material for example perforated or expanded metal or any type of mesh, the central support must be covered firstly with a shaped piece or venting cover 40 FIG. 40 to allow the venting to take place without the melted material passing directly through the skin-strainer into the venting passage 37.

Where the support is a sand core, as shown in FIG. 41 care must be taken that the mold cavity venting passage 37 is independent from the core vents 41 which allow the venting to the outside of the mold, of the gases evolved within the core itself due to the heat supplied by the melted metal. The FIG. 42 shows a through hole core 18 which being a shell core do not produce any significant quantity of gases and which offer the possibility of a wide communication to atmosphere.

The third solution which is to be used in particular in metallic molds, utilizes a venting pellet 42 or 43, which is a small bonded sand core or any other refractory and porous material with a shape preferably in the frustrum of a cone as illusted in FIG. 43*a* and 43*b*. This pellet is positioned in a mold cavity such that the pellet must be inserted with a slight pressure to have its base level with the mold casting cavity surface. The top of the pellet is connected to atmosphere and the venting effect is produced through the sand core itself as in FIG. 43*a* or eventually reinforced through one or several small venting passages as in the venting pellet 43 shown in FIG. 43*b*, this passage being small enough to allow the metal to enter at the most only to a small degree before solidification.

The venting pellet would be ejected at the ejection of the mold and would be replaced for the next casting. If no flash is formed and the pellet is not ejected simultaneously with the casting, or if it does not collapse under the effect of the heat, the pellet could be used for several castings.

As shown in FIG. 44 the pellet 43 can also be used at the centre of a metallic support forming a through hole over which a skin-strainer is located, this pellet being used as a safety measure if the metal could ever reach the centre of the support. In such case the pellet would be ejected automatically and simultaneously with the casting and the pellet should then be replaced.

The further alternative is to provide a venting core 44, as shown in FIG. 45, which applies particularly to sand molds 45. The venting core, which for ease of manufacture will preferably be round and forming a double core print by the utilization of two concentric frusta of a cone with a shoulder interconnecting the two frustra.

When the venting core 44 is positioned in the mold it will be levelled with and reproducing the casting surface. Its larger frustrum will have an accurate fitting in the mold, not tight and nor loose, while the smaller frustrum will have a fitting tight enough to keep the core in position. If necessary fixing foundry nails 30 may be used for reinforcing the venting core position as shown in FIG. 45.

Mold casting cavity venting grooves 27 will be provided extending up the sides of the core, these grooves being small at the casting surface and increasing in size as they move upwardly along the outer surface of the core.

The necessary number of these venting grooves will determine the size and the number of the venting cores to be used. They should be located at or next to the top part of the mold casting cavity and next to the skin-strainer.

These venting cores allow the venting to take place without creating a fettling operation which is generally created by the usual form of a vent. Also it avoids the possibility of some sand or dirt entering into the mold casting cavity through the mold vent 39.

The venting through a venting tube or through a skin-strainer central support gives the best type of venting as these methods provide direct venting of the critical area underneath the skin-strainer where turbulences must be avoided. Nevertheless another very good solution is given by a skin-strainer holder core as shown in FIG. 26*b*.

As shown in FIG. 46 the chaplet 28 may be formed with a hollow stem to allow the venting to take place through the chaplet. The pressing of the chaplet between the bottom part of the mold and the skin-strainer will seal the contact of the chaplet with the bottom of the mold casting cavity.

The skin-strainer open area which is the sum of all of the individual areas holes and gaps, through which the metal can flow when using the strainer, is selected and adjusted as required. The hole size, shape, distribution and number of holes, or the gap width and length around the skin-strainer, or combination of the two are selected to give the required filling of the mold with the minimum of turbulence and with the required filtering of the inclusion and the required straining.

Usually the holes through the skin-strainer will generally be of the same size and evenly distributed in order to obtain a flow of metal as even as possible all around the pouring area, but sometimes the necessity to avoid some metal cascading requires a selective location of the strainer holes.

The hole shape can be any desired shape such as round, square, oblique, or fili-form in the case of a gap. The holes can also be tapered or parallel throughout their length through the skin-strainer.

A special case for the skin-strainer open area appears when the strainer material melting point is only slightly above the temperature of the metal to be poured through the skin-strainer. In this case some of the strainer material may pass with the melted metal due to the erosion effect around the strainer hole walls. If this material is not detrimental to the melt a strainer can be formed from this material, with the strainer hole size made initially smaller than it should be and the strainer thickness adjusted so that by the end of the pouring time the hole size would not be bigger than an acceptable value.

This smaller hole size at the commencement of pouring facilitates the conduit choking and as the hole size increases during the pouring lapse, the pourer will progressively increase the pouring rate to keep the metal level constant in the sprue-feeder.

The skin-strainer open area can be adjusted as desired for obtaining the required flow, and its open area can be changed from its maximum value to nothing while using the same basic skin-strainer.

This possibility reduces the tooling expense or the storage expense involved in obtaining these skin-strainers, a point which is important when the amount of every type of castings to be produced is not sufficiently large.

This variation of skin-strainer open area can be obtained in different ways and the selection of the manner of varying the area will depend upon the casting configuration, the number of castings to be made, the material of the basic skin-strainer and the like.

Thus as shown in FIG. 47*a* a metallic ring cover 46 in the form of an annulus to have an external shape the same as that of the skin-strainer and an internal contour which will leave the required number of holes in the centre to obtain the required flow. Generally this annulus would be placed and pressed between the skin-strainer and the corresponding mold seat to locate the cover in position.

It is also to be noted that there is an automatic reduction of the open area by varying the sprue-feeder as well, and also the central support 38 when this is provided as in FIG. 47*a* and when possible by varying its contour the open area can be adjusted.

As shown in FIG. 47*b* the central area can be adjusted by positioning a central cover over the central support 38 and its external shape and configuration can be selected as desired and is placed between the central support and the skin-strainer itself.

Furthermore the various holes in the skin-strainer themselves may be blocked or closed depending upon the skin-strainer construction and could be blocked with some material such as a refractory material, for example bonded core sand, or if the strainer is metallic various of the holes could be welded to close these holes.

Having a sprue-feeder and a skin-strainer at its bottom, the feeding of the casting takes place through the skin-strainer open area. The skin-strainer by being a small element immersed in the flow of metal, it quickly reaches the melt temperature, which allows after the mold is full and before the metal is solidified the melted metal continuity between both sides of the skin-strainer, even if the hole size is small. If the size of the sprue-feeder is apportioned with the casting, this melted metal continuity will last long enough to have the casting solidifying first. Putting this point in another way it is possible to say that the evolution of the isothermic lines during the solidification process is not substantially different if there is or there is not a skin-strainer between the sprue-feeder and the casting.

The use of exothermic sleeves or of insulating sleeves, the use of exothermic powder or of insulating covers for reducing the volume of the feeders can be quite suitably combined with the gating system object of this invention in order to minimize even more the amount of metal involved in the whole gating system.

The sprue-feeder must be prefilled and choked as quickly as possible during the pouring operation in order to have it working in a full conduit condition most of the pouring time, which assures that the pouring can be uniform all around the straining surface, that the sucking of air into the mold is avoided and that the filtering effect is kept to a maximum.

The speed of this prefilling will generally depend on the pourer's ability or on the overhead melt distributor which will be dealt with later on.

In any type of gating system the cost of separation of the feeders or risers must be considered and kept to a minimum as the fettling operations in the foundry industry are generally costly. The present gating system with its skin-strainers reduce the fettling cost substantially as there are no classical runners and ingates to eliminate and as the sprue-feeding separation is made much easier by having them connected to the casting only through the skin-strainer open area.

Once a sand molded casting is shaked out or a permanent mold casting is extracted from the mold, the sprue-feeder will most often be able of simply being knocked off preferably when the castings are still hot.

Figure 48:
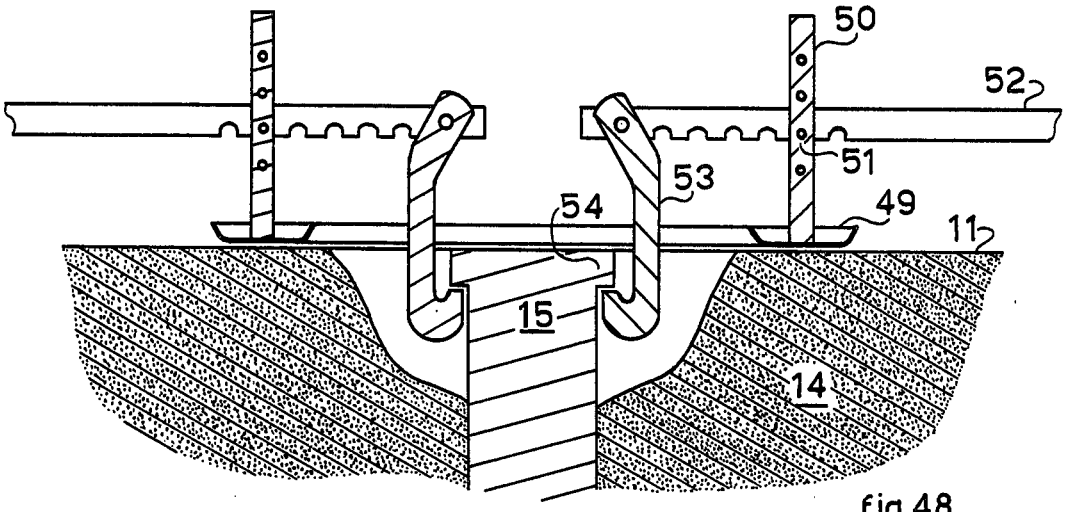
FIGS. 48 and 49 show examples of sprue-feeder extractor.
Figure 49:
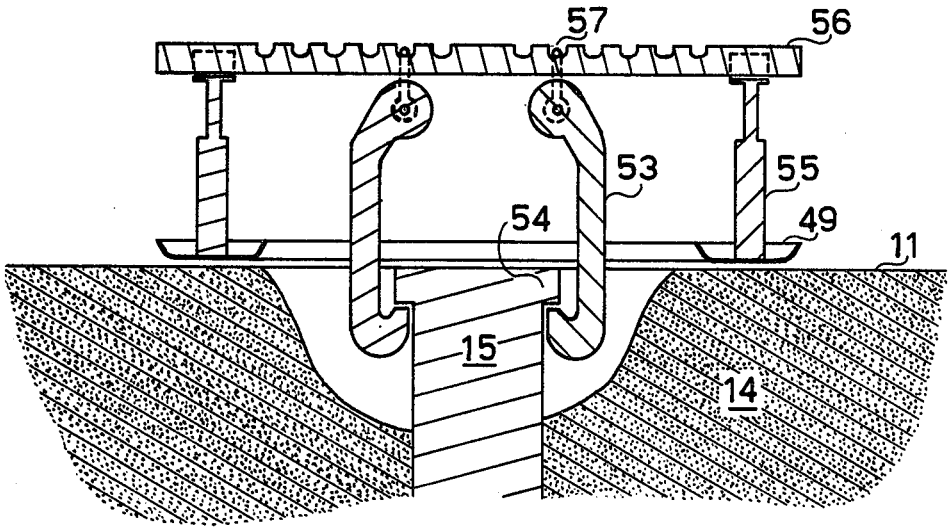

For the sprue-feeder which still cannot be easily knocked off, an adjustable sprue-feeder extractor 48 as shown in FIGS. 48 and 49 can be used for breaking the casting sprue-feeder connection preferably when the casting and the sprue-feeder are solid but are still hot enough to have not yet developed any degree of strength, and before the shaking out, as the location of the sprue-feeder extractor will be generally easier on the top mold surface.

As shown in FIG. 48 the sprue-feeder extractor will be of steel and formed with an annular base 49 to which two double columns 50 are welded, in which extractor every double column 50 has a vertical row of adjusting holes, whose holes correspond in diameter to a loose supporting pin 51, having a notched loose lever 52 standing on the pin 51 through one of its adjusting notches, being one end of the lever 52 articulated to a hook 53, which hook 53 is located underneath a sprue-feeder flange 54 when the other end of the lever 52 is pressed downward.

As shown in FIG. 49 the sprue-feeder extractor will also be of steel and formed by an annular base 49 to which two jacks 55 are welded, the top of the moving shaft being U-shaped to support a loose and notched lifting bar 56, in two of which adjusting notches are located two links 57, which links are articulated to the two hooks 53. The two hooks 53 are also located underneath a sprue-feeder flange 54 when the two jacks are lifted to perform the sprue-feeder extraction.

Once the casting has been produced the skin-strainer separation from the sprue-feeder or from the casting if not always essential is desirable. The skin-strainer separation if its material is breakable generally will not present any major problem.

If the skin-strainer is metallic and non-breakable several ways of separation are possible. The skin-strainer is easily separated from the casting or from the sprue-feeder whichever is the part where the skin-strainer sticks after knocking off the sprue-feeder. If the skin-strainer tends to stick too much for being separated either from the casting or from the sprue-feeder, then the separation can be carried out while the casting and the sprue-feeder are still hot or the skin-strainer can be protected by painting it with some core oil, linseed oil being very effective, spraying it with some fine silica sand and then placing the strainers in a core oven up to the moment the protective layer becomes dry and firm. If the sticking of the skin-strainer either on the casting or on the sprue-feeder is not damaging for any of those parts, and in this case as it will be mentioned when dealing with the skin-strainer manufacture, the shape given to the skin-strainer can favour its sticking either to the sprue-feeder or to the casting as considered desirable.

Basically the skin-strainer is of one use but in some cases, for example with castings produced in permanent molds where the separation of the skin-strainer can be done immediately after the casting ejection and when the casting and the sprue-feeder are still hot and slightly soft, the skin-strainer can be recovered almost undamaged and a low cost reconditioning operation can be considered.

The skin-strainers can be manufactured by any of the known techniques, and if they are formed from flexible materials which are generally metallic the skin-strainer would be successively blanked, pressed and pierced or punched or drilled. Alternatively the flexible skin-strainers can be manufactured of pre-perforated, expanded, woven metallic materials. If they are formed rigid metallic materials they would be cast, machined from wrought materials or by a combination of casting and machining procedures.

When utilizing highly metallic refractory materials to make the skin-strainers, powder metallurgy techniques may be considered and for example if molybdenum is used, a skin-strainer which would be able to retain its strength at extremely high temperatures is produced.

When using rigid non-metallic materials such as sand core materials, ceramics or refractory materials any of the known techniques may be used for making these skin-strainers.

If desired reinforcings of the skin-strainer shape can be utilized and as shown in FIG. 50 this may be on the casting side of the skin-strainer, or can be fitted to the skin-strainer to extend into the sprue-feeder as shown in FIG. 51, or can be on the mold side to extend into the mold portion itself as shown in FIG. 52.

The rigid non-metallic skin-strainer can be reinforced for example as shown in FIG. 53 where the skin-strainer 20 can be formed of a breakable and more refractory material than steel 58 like a core bonded sand or a ceramic material having embedded therein a reinforcement which could be of steel open material 59 such as expanded, perforated, mesh or the like.

Alternatively as shown in FIG. 54 the ceramic or core bonded sand 58 can form a form of cladding over a steel skin-strainer 60. In this case where the resistant steel plate 60 is covered on one side only with a breakable but more refractory material than steel, the non-metallic face of the skin-strainer would be on the sprue-feeder side 61*a* protecting the metallic part during the short lapse corresponding to the pouring time, the metallic part being then in the mold casting cavity side 61*b*.

The skin-strainer 20 located in a metallic mold 25 over a through hole support as shown in FIG. 55*a* can be left predeformed at its manufacturing stage, so that when the mold is closed as shown in FIG. 55*b* the skin-strainer 20 is pressed against the surface of the mold sealing therearound with the surface of the skin-strainer coincident with the casting surface.

The overhead melt distributor is a runner system located at the top of the mold so that by the melt distributor it is possible to fill a mold having several sprue-feeders and using only one ladle.

Figure 56A:
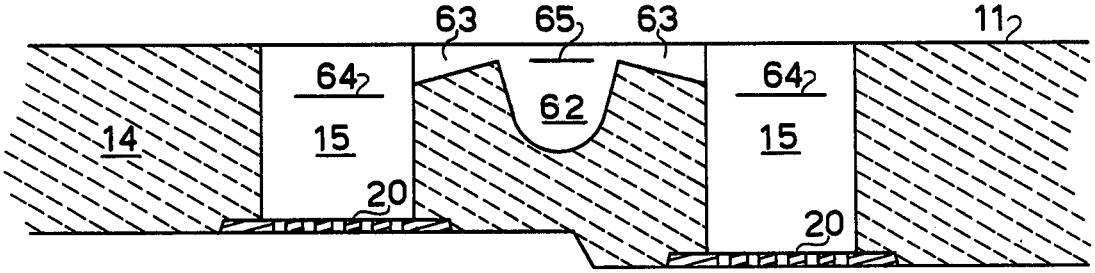
FIG. 56*a* shows a schematic view of an open overhead melt distributor built in the top mold part.
Figure 56B:
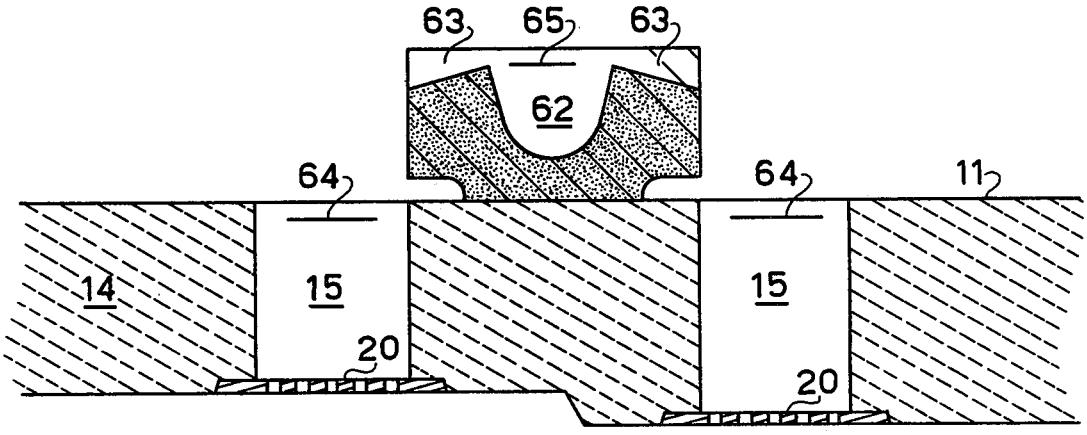
FIG. 56*b* shows a schematic view of an open and removable overhead melt distributor.
Figure 57:
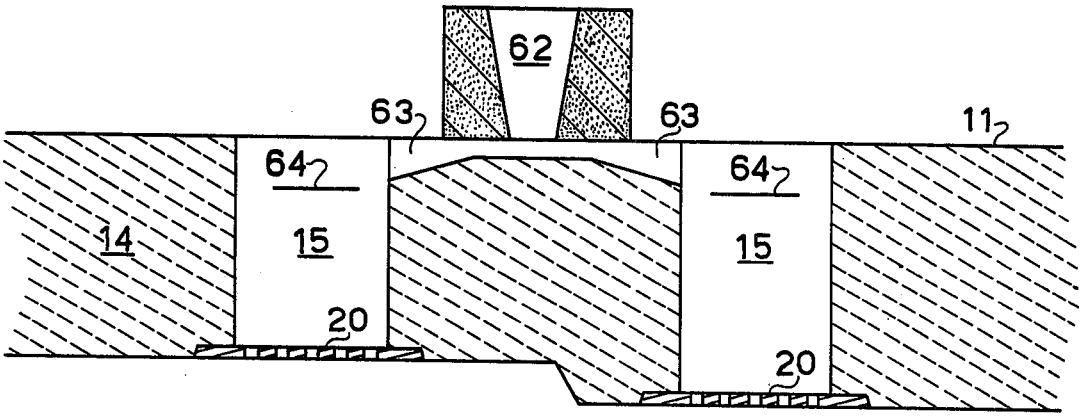
FIGS. 57 to 59 shows schematic views of closed overhead melt distributors.
Figure 58:
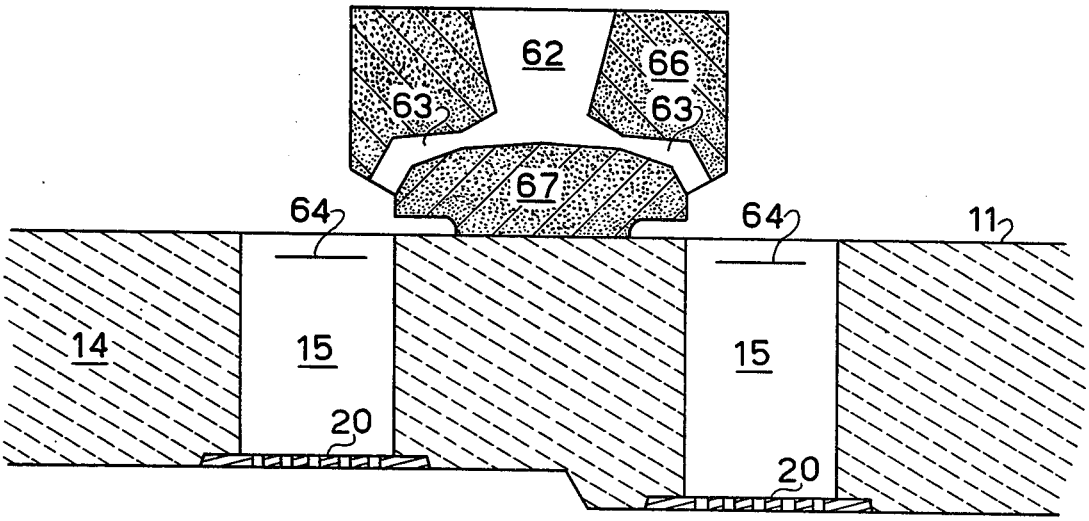
Figure 59:
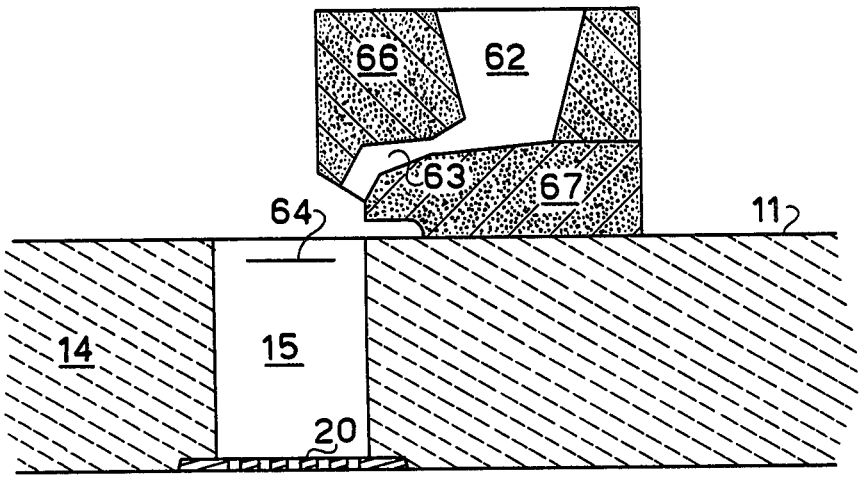

The overhead melt distributor can be an open system as shown in FIGS. 56*a* and 56*b* or can be a closed system when a cover is added as shown in FIGS. 57, 58 and 59.

Referring to FIG. 56*a* the overhead melt distributor is included in the mold body itself with sprue-feeders 15 and skin-strainers 20 located beneath the mold level 11. Included in the mold is the distributor sprue 62 and the distributor runners 63 to direct the melted metal into the sprue-feeders 15. At the completion of the pouring the metal level in the sprue-feeders is shown as 64 and in the distributor sprue the metal level would be as shown at 65.

A similar system is shown in FIG. 56*b* but where the overhead melt distributor is formed as a separated part from the top of the mold.

FIGS. 57 and 58 show similar views in a schematic manner but illustrating a closed distributor arrangement, the distributor having a pouring point or sprue 62 where the pouring from the ladle can be carried out safely without splashing and it is preferred that the distributor be of the type as shown in FIG. 58 where the distributor is closed, separate from the mold itself and formed by a top 66 and a bottom 67.

FIG. 59 shows an overhead melt distributor for pouring only one sprue-feeder which arrangement can be useful in some cases, for example when the distributor sprue is more accessible for the ladle than the sprue-feeder.

The overhead melt distributor will in principle be particular to every casting, nevertheless its practical applications will show that standardization and interchangeability will generally be possible.

The distributor can be formed of any sand based molding sand or preferably any type of bonded core sand, or it may be of a metallic construction.

The overhead melt distributor must have a sprue of sufficient capacity to allow a safe pouring without splashing and also to allow a quick filling and choking of the distributor, and while the distributor is in such choked condition it is so designed that the metal it delivers at every one of its outlets is sufficient to quickly and simultaneously fill all the sprue-feeders so that a cushion of melted metal is built up inside each sprue-feeder and this then acts as a further skimmer where any possible inclusions tend to float and remain on the top of the melted metal.

After the sprue-feeder prefilling is completed the metal level in the sprue-feeders is kept constant by reducing the pouring rate to the metal rate going through the skin-strainers.

To ensure a saving of melted metal and to reduce the handling of the metal both melted and solidified and to simplify the mold shaking out, it is highly desirable that the distributor be empty when the mold is full. This also allows an overhead melt distributor to be reused several times. To obtain an empty distributor after pouring, the vertical longitudinal profiles of the distributors runners must be continuously tapered from the centre of the distributor sprue to its outlets.

Thus the pourer must know how many inches of the sprue-feeder height will be filled by the metal inside the distributor when he stops pouring. Consequently the pourer must take care to keep the melt level in the sprue-feeder at a level for convenience called the sprue-feeder pouring safety level which is so adjusted to avoid any sprue-feeder overflow when the pourer stops pouring on filling of the mold casting cavity.

Figure 60:
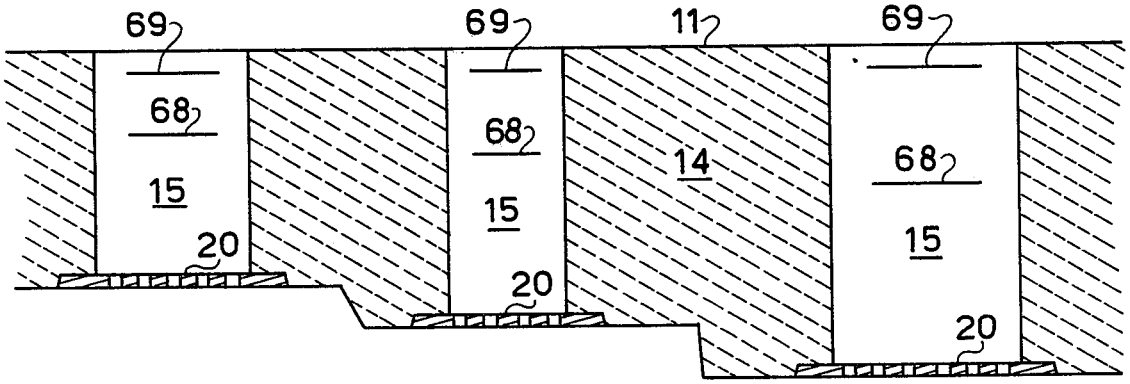
FIG. 60 shows the melted metal levels inside the sprue-feeders.

If the mold has several sprue-feeders with different levels and sizes for their skin-strainers with the sprue-feeders themselves also being of different sizes as shown in FIG. 60; the sprue-feeder safety level 68 could also vary from one sprue-feeder to the other. In that case the pourer should adjust his pouring to just one of the sprue-feeder metal level.

Thus the pouring operation includes the pouring by keeping the distributor full up to the moment when the melt level in the sprue-feeders is adjacent the safety level 68. From then the pourer slows the pouring rate to keep this safety level generally constant up to the moment the metal level starts rising again because the mold casting cavity is full. This is the moment when the pouring must be stopped with the metal having its level in its sprue-feeder after pouring as indicated by level 69.

The pouring operation can also be considered by having a predetermined amount of the metal to be poured in the ladle and then pouring at the full distributor rate up to the moment the ladle is empty or up to the moment the ladle has delivered the corresponding weight of metal, which can be determined by hanging the ladle from a scale's hook. If this method of pouring is used provisions must be taken in order to calculate the sprue-feeders heights and volumes to be of sufficient volume in order to avoid any overflow, and also provides to strengthen the skin-strainers and their support.

The size and shape of the cross-sections of the distributor channels are in relation to the corresponding sprue-feeder cross-sections and volumes and also in relation to the corresponding skin-strainer open areas.

When pouring into the overhead melt distributor, after having choked the distributor every one of the runner outlets will be pouring metal at a full rate R which rate may be maintained during the entire pouring lapse, or more generally it will be operated at two main rates of melt delivery the same full rate R first followed by a lower rate r with an unfilled distributor.

The larger rate R will correspond to the rate during the sprue-feeder prefilling lapse (PFL) during which lapse the distributor will be operating in a full condition. The rates of deliveries R1, R2, R3 etc during this sprue-feeder prefilling period at each distributor outlet 1, 2, 3, etc., will be in proportion to the values of the products V1×S1, V2×S2, V3×S3, etc., where V corresponds to the sprue-feeder volumes up to their safety level and S refers to the effective open area of the corresponding skin-strainer. The values for V and S will depend on the casting configuration.

The smaller rate r will correspond to the pouring rate from the moment the sprue-feeder is prefilled to the moment when the mold is full, which lapse is termed the normal filling lapse (NFL). The rates of the melt deliveries r1, r2, r3, etc., during this second lapse at each distributor outlet 1, 2, 3, etc., will be in proportion of S1, S2, S3, etc.

When all the sprue-feeders and the skin-strainers are the same, which will be a very common case, all the rates R must be identical as well as the rates r, and consequently all the distributor runners will have the same size and shape.

Each runner in an overhead melt distributor has a critical cross-section which is its minimal cross-section. This critical cross-section regulates the amount of metal passing through the channel during both the pouring lapses, that is the PFL and the NFL.

In FIGS. 61, 62, 64 to 67 different vertical runner critical cross-section shapes 70 are shown. The critical cross-section as shown in FIGS. 61*a* and *b* can be used for distributors which in their working condition are permanently full, or also for distributors having only one outlet, as with several outlets and with this type of critical cross-sections it would be difficult in an unfilled distributor to maintain nearly constant a proportion between the different rates r1, r2, r3 etc. In FIG. 61*a* the runner is shown in the distributor top whereas the runner shown in FIG. 61*b* is in the distributor bottom and thus is below the distributor parting surface 71.

Referring to FIG. 61*c* there is shown the horizontal cross-section of the distributor runner, the runner opening on the right to the distributor sprue with the melted metal flowing as per 72 towards the sprue-feeder and through the critical cross-section 70.

FIG. 62 shows critical cross-sections of a distributor runner formed about a distributor parting surface 71 having a top runner 73 and a bottom runner 74, FIG. 62*a* showing an empty runner, FIG. 62*b* showing the metal level 75 during the prefilling lapse (PFL) and FIG. 62*c* showing the metal level 76 during the normal filling lapse (NFL). FIG. 62*d* shows a view on a horizontal projection showing the cross-sections of the top and bottom runners with the direction of flow of the melted metal again being indicated by an arrow 72. FIG. 63 shows vertical cross-sections of the distributor sprue associated to the type of runner shown in FIG. 62.

It will be observed that with the type of distributor design shown in FIGS. 62 and 63 it is easier to keep approximately constant the proportion for r1, r2, r3 etc., if the bottom runner areas are in the proporation of S1, S2, S3, etc., and if the metal level 76 is kept within the distributor bottom runner 74. With the narrow shape given to the distributor bottom runner 74 a variation of the metal level in the sprue only gives a minor change in the effective rate of metal passing into every runner.

The runner critical cross-sections shown in FIGS. 64 to 67 are such that the top 73 and bottom runner 74 are made separate, and as shown in FIG. 68, where the distributor sprue cross-section corresponds to the runner critical cross-section of FIG. 67, there is an annular core 77 located in the distributor bottom part to choke or restrict the first part of the distributor bottom runner 74 and so to control more accurately the metal rate during the Normal Filling Lapse (NFL).

For applying the principle of the overhead melt distributor to a mold with several sprue-feeders and corresponding skin-strainers FIG. 69 shows different possible and simplified arrangements made with separate elements which are, the removable distributor centre 78 showing the location of the runner critical cross-sections 70, the removable lateral runner extension 79, the removable main runner extension 80, elements which can be prepared by using standard adaptable tooling.

Another possibility for molds with many sprue-feeders is to pour a group of the mold sprue-feeders by using one distributor and pouring the others individually or again grouped around other distributors. Of course this method implies the operation with several pouring ladles.

When considering sand molding the melt distributor can be designed in such a way that it can be easily moved from one mold to the next and preferably the distributor need not be in overall contact with the mold but it is preferably located above and at least around the sprue-feeders to prevent any dirt being allowed to enter the sprue-feeders, as shown in FIGS. 58, 59 and 70, when positioning the distributor. This heightening of the distributor around the sprue-feeder areas will generally favor, for long production runs to a special support for the distributor, the distributor having a unique location on the support and the support a unique location on the mold.

The special support provides a common base, instead of the top mold surface, for assembling the complete overhead melt distributor when operating as shown in FIGS. 69. It also allows the distributor to be raised to the correct level when insulating or exothermic sleeves which extend over the top surface are used around the different sprue-feeders and generally will ease the distributor handling.

If the overhead melt distributor is sand based any sand molding can be applied or preferably any core making procedure having a core box for its bottom part and another one for its top can be used.

If the distributor is metallic it will be made like any permanent mold.

Figure 70A:
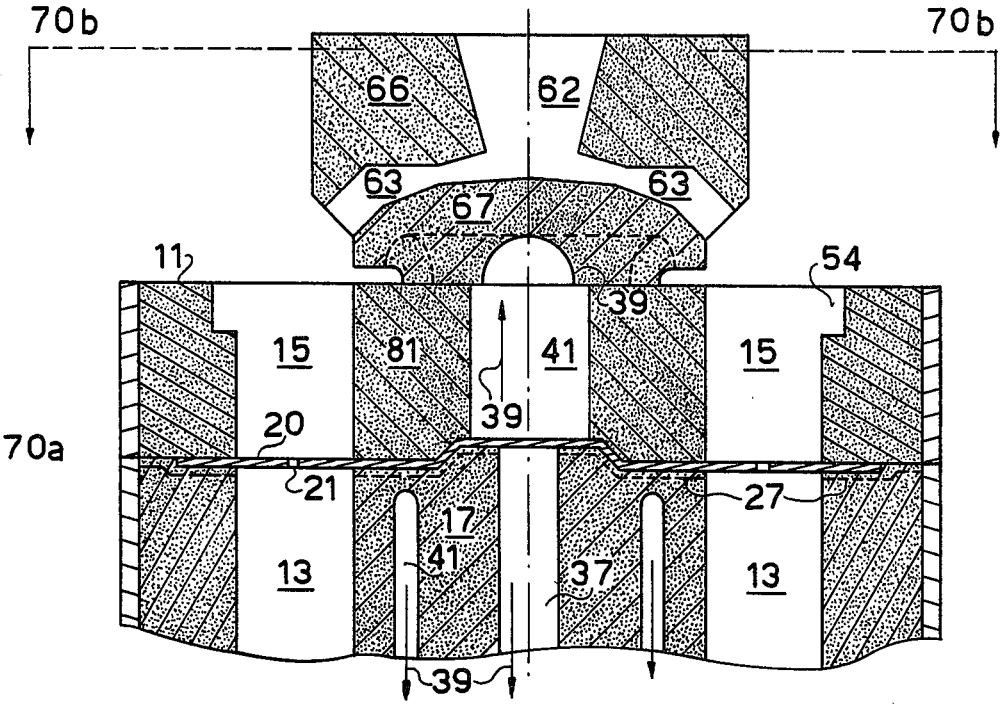
FIG. 70 shows an overhead melt distributor used to pour a single annular sprue-feeder at several different points.
Figure 70B:
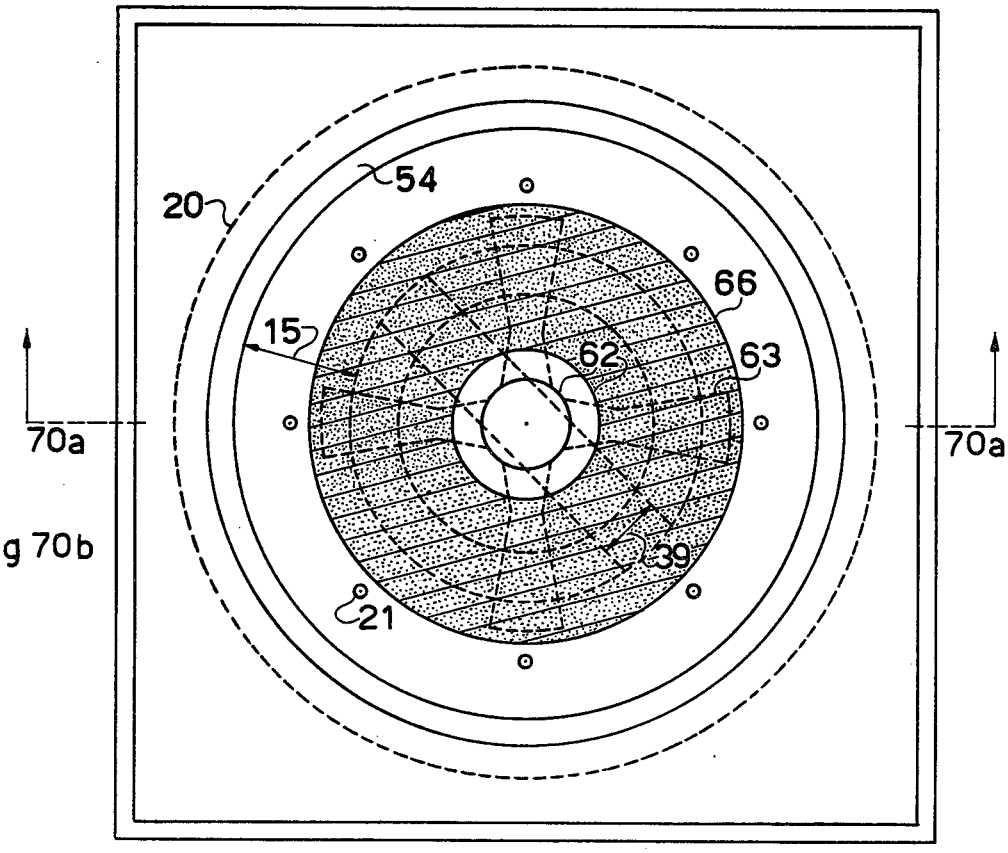

In FIGS. 70*a* and 70*b* the gating system object of the present specification is applied to the pouring in a sand mold of a sleeve in vertical position, whose mold casting cavity is shown in 13, and having a central bore 17, the skin-strainer 20 forming the top surface of the sleeve casting, and has over it an annular sprue-feeder 15 formed externally by the top part of the mold and internally by another core 81. Venting of the mold casting cavity is provided by venting grooves 27 around the skin-strainer and extending along the mold parting surface 19, also by venting grooves 27 over the core 17 and up to the vent 37. The pouring is done through a two part closed and removable overhead melt distributor with four runners 63 delivering metal to the sprue-feeder. The sprue-feeder has a flange 54 for using a sprue-feeder extractor for breaking the sprue-feeder casting connection after removal of the distributor, before the shaking out by just opening the mold top surface in two points diametrically opposed and around the flange 54 in order to locate the two extractor hooks underneath this flange.

What I claim is:

1. In a gating system for a gravity poured foundry mold having at least one casting cavity and at least one mold parting surface connecting the full contour of the mold casting cavity with the external surface of the mold, said gating system establishing necessary flow paths between the outside of the mold and the mold casting cavity, the improvement comprising:

a conduit formed by at least one of the flow paths established by said gating system, said conduit open on opposite ends thereof and extending directly from an outer mold surface to the surface of said cavity, said conduit receiving molten metal and guiding said metal direct toward the mold casting cavity, such that during pouring of the mold, all molten metal passing through said conduit flows directly toward the mold casting cavity;

a stationary skin-strainer distinct from said conduit and said mold and interposed between said conduit and said mold casting cavity along the surface of the mold casting cavity and such that said skin-strainer follows the contour of the surface of said mold casting cavity, said skin-strainer operative in its stationary position to communicate to the mold cavity all molten metal to be received by said cavity from said conduit during the casting operation, said skin-strainer defining at least one aperture and having a total aperture cross sectional area which is substantially smaller than the minimum cross sectional area of the conduit to significantly control the rate of flow of molten metal from the conduit to the casting cavity, said skin-strainer choking said conduit such that such conduit quickly fills with molten metal upon pouring of said molten metal to said conduit, said skin-strainer prefabricated and sufficiently strong to withstand the full impact of falling molten metal poured into said conduit, and to support the full metalstatic pressure of the molten metal contained in the choked conduit during filling of said cavity; and, retaining means for supporting the skin-strainer in position along the surface of the mold casting cavity throughout pouring and solidification of said molten metal, said retaining means sufficiently strong to transfer the impact and pressure of said molten metal to the mold body substantially independently of the positioning of said skin-strainer with respect to the parting surface of the mold;

whereby the combination of said skin-strainer and said retaining means withstands the impact of the molten metal during pouring thereof into said conduit, and supports the full pressure of a column of molten metal contained in the choked conduit during filling of said mold casting cavity.

2. A gating system as claimed in claim 1, wherein said retaining means comprises means for attaching said skin-strainer directly to an upper mold casting cavity surface, said skin-strainer then supported solely by that upper part of the mold.

3. A gating system as claimed in claim 2, wherein the skin-strainer contour is formed to a cup like shape and the sides of the cup like skin-strainer are embedded in the mold body to provide suitable anchorage within the body of the mold where the skin-strainer is located.

4. A gating system as claimed in claim 1, wherein said retaining means comprises:

a removable mold element forming a part of the outer casting surface, which element is inserted in a matching mold recess and supported by the body of the mold, said mold element forming at least a part of said mold conduit, said skin-strainer anchored to said removable mold element and retained thereby along the surface of the mold casting cavity

5. A gating system as claimed in claim 1, wherein said retaining means comprises;

a recessed portion of the mold in the mold casting cavity around the end of said conduit; and, an element passing through the mold casting cavity, said element and said skin-strainer conterminous to position the skin-strainer with the mold such that upon closing of the mold the peripheral portion of said skin-strainer contacts said recessed portion of the mold, said skin-strainer then locked in position by said element to form a continuous mold casting cavity.

6. A gating system as claimed in claim 1, wherein said skin-strainer provides at least one aperture formed between an edge of the skin-strainer and an adjacent part of the mold conduit contour.

7. A gating system as claimed in claim 1, wherein said retaining means comprises:

an element passing through the mold casting cavity and supporting said skin-strainer, which element is compatible with the casting requirements, which skin-strainer is located along one part of the mold casting cavity upper surface, for which cavity at least one venting passage is established through said supporting element, which passage starts adjacent the skin-strainer level and is protected from the poured metal passing through the skin-strainer while the mold casting cavity is being filled, that protection lasting up to just before the melted metal in the mold casting cavity reaches adjacent to the skin-strainer level.

8. A gating system as claimed in claim 1, further comprising at least one conical venting pellet of porous material, said pellet located at a part of the inside mold casting cavity surface requiring a venting passage and inserted in the mold cavity wall, said pellet reproducing at its bigger end the mold casting surface, the smaller end of the pellet being open to atmosphere.

9. A gating system as claimed in claim 1, further comprising at least one conical venting core, said venting core located at a part of the inside mold surface requiring a venting passage and inserted in the mold cavity wall, said venting core reproducing at its bigger end the mold casting surface, the smaller end of the core being open to atmosphere, said venting core having at least one venting passage connecting the mold cavity along the core side to the core smaller end.

10. A gating system as claimed in claim 1, wherein said conduit supplies molten metal to said casting cavity during filling of said cavity, said stationary skin-strainer having a thickness at said at least one communication aperture and said aperture having a cross-sectional area suitable for maintaining molten metal continuity between said conduit and said cavity during feeding of said cavity once said mold is full, all while said strainer is in said stationary position.

11. A gating system as claimed in claim 1, further comprising at least one overhead melt distributor removable and distinct from said mold, which is formed by a bottom part and a top part, each of these two parts formed themselves by at least one element, said distributor having a pouring sprue for receiving molten metal and at least as many channels and outlets as there are mold flow paths to be poured from said overhead melt distributor, from which distributor and during the pouring operating, metal is free-fallingly poured into each of those flow paths through the distributor respective channel outlets, each channel continuously downwardly tapered from the center of said distributor sprue, in which mold at least one of said flow paths is formed by said conduit, said distributor simultaneously delivering a requisite amount of molten metal to each conduit and the corresponding mold casting cavity.

12. A gating system as claimed in claim 11, wherein each of said channels pouring into the conduits has a critical section formed by two separated sections, one located in the distributor bottom part and having a sectional area in proportion to the total cross section of said aperture of the corresponding skin-strainer, and the other channel section in the distributor top and having a sectional area in proportion to the corresponding mold conduit volume before that skin-strainer, these two channel sections being such that when the distributor is closed and in position at the mold top, the highest level of the bottom part channel section is spaced vertically from the lowest level of the top part channel section.

13. A gating system as claimed in claim 1 wherein said skin-strainer comprises a ceramic material.

14. A gating system as claimed in claim 1, further comprising engagement means at the upper end of the conduit and a conduit pulling extractor for engaging said engagement means and extracting said conduit after solidification of said casting.

15. A gating system according to claim 1 further comprising:

at least one overhead distributor for receiving molten metal and directing said molten metal toward said at least one mold conduit, said distributor removable and distinct from said mold and having at least one outlet for directing said molten metal toward said at least one conduit, said molten metal continuously free falling from said outlet into said conduit during the pouring lapse.

16. A gating system as claimed in claim 15, further comprising said conduit having a cross section shape of an annulus, said overhead melt distributor centrally located in relation to said annulus and having more than one channel and corresponding outlets disposed to cast molten metal at different locations into said annular conduit.

17. A gating system as claimed in claim 1, wherein said skin strainer comprises:

two different elements, a second element formed of a breakable more refractory material than a first element, said second element reinforced by said first element, said second element isolating said first element from direct contact with said molten metal.

18. A gating system as claimed in claim 17 wherein:

said first element comprises metal;

said second element comprises a ceramic material; and, said first element and said second element are conterminous, with said first element contiguous with said mold casting cavity.

19. A gating system according to claim 1, wherein said skin strainer comprises:

a metal.

20. A gating system as claimed in claim 1 further comprising:

said skin-strainer having a further aperture; and, a venting tube having one end passing through said further aperture such that said end of said venting tube is contiguous with, but not penetrating, said mold casting cavity, said venting tube passing through said conduit to a point exterior of the mold.

21. A gating system as claimed in claim 1, wherein said skin-strainer comprises a metal sheet.

22. In a gating system for a gravity poured foundry mold having at least one casting cavity, said gating system establishing necessary flow paths between the outside of the mold and the casting cavity, the improvement comprising:

a conduit formed by at least one of the flow paths established by said gating system, said conduit being open on opposite ends thereof and extending directly from an outer mold surface to the surface of said cavity, said conduit receiving molten metal and guiding said metal directly toward the mold casting cavity such that during pouring of the mold all molten metal passing through said conduit flows directly toward the mold casting cavity;

a stationary skin-strainer distinct from said conduit and said mold and interposed between said conduit and said mold casting cavity along the surface of said cavity such that said skin-strainer follows the contour of the surface of said mold casting cavity, said skin-strainer operative in its stationary position to communicate to the mold cavity all molten metal to be received by said mold cavity from said conduit during the casting operation, said skin-strainer defining at least one aperture and having a total aperture cross sectional area which is substantially smaller than the minimum cross sectional area of the conduit to significantly control the rate of flow of molten metal from the conduit to the casting cavity, said skin-strainer choking said conduit such that said conduit quickly fills with molten metal upon pouring of said molten metal to said conduit, said skin-strainer prefabricated and sufficiently strong to withstand the full impact of falling molten metal poured into said conduit, and to support the full metalstatic pressure of the molten metal contained in the choked conduit during filling of said cavity, said skin-strainer comprising two different elements a second element formed of a breakable more refractory material than a first element, said second element reinforced by said first element, said second element isolating said first element from direct contact with said molten metal; and, retaining means for supporting the skin-strainer in position along the surface of the mold casting cavity throughout pouring and solidification of said molten metal, said retaining means sufficiently strong to transfer the impact and pressure of said molten metal to the mold body;

whereby the combination of said skin-strainer and said retaining means withstands the impact of molten metal during pouring thereof into said conduit, and supports the full pressure of a column of molten metal contained in the choked conduit during filling of said mold casting cavity.

23. In a gating system for a gravity poured foundry mold having at least one casting cavity and at least one mold parting surface connecting the full contour of the mold casting cavity with the external surface of the mold, said gating system establishing necessary flow paths between the outside of the mold and the mold casting cavity, the improvment comprising:

a conduit formed by at least one of the flow paths established by said gating system, said conduit being open on opposite ends thereof and extending directly from an outer mold surface to the surface of said cavity, said conduit receiving molten metal and guiding said metal directly toward the mold casting cavity such that during pouring of the mold all molten metal passing through said conduit flows directly toward the mold casting cavity;

a stationary skin-strainer distinct from said conduit and said mold and interposed between said conduit and said mold casting cavity along the surface of said cavity such that said skin-strainer follows the contour of the surface of said mold casting cavity, said skin-strainer operative in its stationary position to communicate to the mold cavity all molten metal to be received by said mold cavity from said conduit during the casting operating, said skin-strainer defining at least one aperture and having a total aperture cross sectional area which is substantially smaller than the minimum cross sectional area of the conduit to significantly control the rate of flow of molten metal from the conduit to the casting cavity, said skin-strainer choking said conduit such that said conduit quickly fills with molten metal upon pouring of said molten metal to said conduit, said skin-strainer prefabricated and sufficienty strong to withstand the full impact of falling molten metal poured into said conduit, and to support the full metalstatic pressure of the molten metal contained in the choked conduit during filling of said cavity; and, said skin-strainer having two portions, a first portion retained in a recess along the mold parting surface and a second portion extending from said recess such that said skin-strainer is maintained in corbel position during the casting operation.

* * * * *